US007055770B2

(12) United States Patent
Bardos

(10) Patent No.: US 7,055,770 B2
(45) Date of Patent: Jun. 6, 2006

(54) REDUCING MACHINE ROTOR ASSEMBLY AND METHODS OF CONSTRUCTING AND OPERATING THE SAME

(75) Inventor: Gary M. Bardos, Remus, MI (US)

(73) Assignee: Morbark, Inc., Winn, MI (US)

( * ) Notice: Subject to any disclaimer, the term of this patent is extended or adjusted under 35 U.S.C. 154(b) by 170 days.

(21) Appl. No.: 10/774,548

(22) Filed: Feb. 9, 2004

(65) Prior Publication Data

US 2004/0155131 A1 Aug. 12, 2004

Related U.S. Application Data

(63) Continuation-in-part of application No. 09/846,937, filed on May 1, 2001, now Pat. No. 6,880,774.

(60) Provisional application No. 60/446,143, filed on Feb. 10, 2003, provisional application No. 60/246,862, filed on Nov. 8, 2000, provisional application No. 60/203,241, filed on May 8, 2000.

(51) Int. Cl.
*B02C 13/28* (2006.01)

(52) U.S. Cl. ..... 241/189.1; 241/294; 241/300

(58) Field of Classification Search ..... 241/189.1, 241/242, 294, 194, 195, 300
See application file for complete search history.

(56) References Cited

U.S. PATENT DOCUMENTS

| | | | |
|---|---|---|---|
| 286,630 | A | 10/1883 | Orton |
| 389,139 | A | 9/1888 | Dumontier |
| 486,901 | A | 11/1892 | Shimer |
| 824,589 | A | 6/1906 | Ruth et al. |
| 2,865,572 | A | 12/1958 | Lannert |
| 2,986,347 | A | 5/1961 | Stevenson |
| 3,547,360 | A | 12/1970 | Sherman, Jr. |
| 3,642,212 | A | 2/1972 | Voit |
| 3,642,214 | A | 2/1972 | Blackwell, Jr. |
| 3,818,561 | A | 6/1974 | Montana et al. |
| 3,876,158 | A | 4/1975 | Rogers |
| 4,205,799 | A | 6/1980 | Brewer |
| 4,628,976 | A | 12/1986 | Loring |
| 4,892,260 | A | 1/1990 | Hager |
| 4,915,309 | A | 4/1990 | Schmidt |
| 5,070,920 | A | 12/1991 | Morey |
| 5,148,844 | A | 9/1992 | Robinson |
| 5,271,440 | A | 12/1993 | Bradstreet, Jr. et al. |
| 5,307,719 | A | 5/1994 | MacLennan |
| 5,372,316 | A | 12/1994 | Bateman |
| 5,379,951 | A | 1/1995 | Hughes |
| 5,409,047 | A | 4/1995 | Jorgensen |
| 5,497,950 | A | 3/1996 | Schrodl |
| 5,713,525 | A | 2/1998 | Morey |
| 5,967,436 | A | 10/1999 | Balvanz |
| 6,059,210 | A | 5/2000 | Smith |
| 6,142,400 | A | 11/2000 | Balvanz et al. |

FOREIGN PATENT DOCUMENTS

| | | |
|---|---|---|
| DE | 88 00 928.9 | 1/1988 |

*Primary Examiner*—Mark Rosenbaum
(74) *Attorney, Agent, or Firm*—Reising, Ethington, Barnes, Kisselle, P.C.

(57) ABSTRACT

A rotor assembly operable with anvil mechanism for comminuting waste wood and other fragmentable material has a rotating drive shaft with a series of rotors fixed in axially spaced relation thereon. A series of radially projecting hammers mechanisms are situated along the axis of the shaft and powered by the shaft. Fragmenting knives are removably secured to the leading outer portions of the hammer mechanisms. The hammer mechanisms include sidewisely reversible hammer legs having portions received by the rotors sidewisely contiguously.

20 Claims, 23 Drawing Sheets

REDUCING MACHINE ROTOR ASSEMBLY AND METHODS OF CONSTRUCTING AND OPERATING THE SAME

This application is a continuation in part of application, Ser. No. 09/846,937 filed May 1, 2001 now U.S. Pat. No. 6,880,774 and claims the priority thereof and of provisional application Ser. No. 60/203,241 filed May 8, 2000, and also the priority of provisional application Ser. No. 60/246,862 filed Nov. 8, 2000. The application also claims the priority of provisional application Ser. No. 60/446,143 filed Feb. 10, 2003.

This invention relates to rotor assemblies for heavy machinery such as hammer mills and wood hogs for fragmenting waste wood and other products, including demolition debris, stumps, pallets, large timbers, and the like into particulate or chips which are useful, for example, as mulch, groundcover, and fuel.

BACKGROUND OF THE INVENTION

The present invention is directed to improved rotor constructions of rugged and durable character. The present assignee owns U.S. Pat. No. 5,713,525, issued Feb. 3, 1998, for a typical wood hog machine and U.S. Pat. No. 5,419,502, issued May 30, 1995, for a typical tub grinder hammer mill system. Both patents are incorporated herein by reference. The rotor assemblies of the present invention are usable with either type of machine. A cutter tooth assembly for such machines is also disclosed in U.S. Pat. No. 3,642,212 (also incorporated herein by reference), issued Feb. 15, 1972, for a cutter tooth assembly for such grinders or fragmenters.

Such machines, which usually comprise a rotor having a plurality of teeth that pass through openings formed in anvils or the like, and wear rapidly, must be replaced frequently. As the teeth of the rotor wear, their cutting edges become rounded or blunted and less effective in their grinding or cutting function. When in use in the field, a considerable supply of replacement cutting teeth must be maintained.

The present rotor assembly is particularly constructed to overcome some of the difficulties experienced with prior art machinery and utilizes longer lived cutters. The construction in some forms also utilizes separately replaceable deflecting lobes or humps which extend radially and new methods of constructing and operating rotor assemblies.

SUMMARY OF THE INVENTION

A fragmenting rotor assembly devised for waste wood and other fragmentable material incorporates a drive shaft mechanism and a series of radially projecting axially spaced adjacent hammer heads situated along the axis of the shaft mechanism and powered by the shaft mechanism. Replaceable knives or hammers are removably secured to the leading portions of the hammer heads and these knives have axially extending radially outer comminuting edges on the outermost portions of the knives which will cooperate with anvil surfaces.

The knives, in one aspect of the invention, are double edged and deflector lobes or humps are provided which in one embodiment extend radially sufficiently to deflect material tending to impact knives which have secondary cutting edges. Those lobes, at least partly in the radial plane of the hammer heads, have outer ends rotating in a circumferential path lying radially short of the circumferential path of the radially outer edges of the knives, but radially beyond the knife secondary inner edges. In another version of the invention, useful on tub grinders particularly, the knives are single edged. In still another portion of the disclosure the hammer heads are tilted radially forwardly and circumferentially offset knives have axially overlapping rotary paths of travel. Still further, another aspect provides hammers which are so carried that overlapping radial paths of travel are radially overlapping.

One of the prime objects of the invention is to provide an aggressive cutting and fragmenting assembly which will operate for a prolonged time in heavy wear conditions.

Another object of the invention is to provide a hammer and knife assembly which is relatively inexpensive to manufacture and which has knife edges which will withstand considerable compressive impact forces and resist fracture.

Another object of the invention is to provide an assembly in which the knives can travel in radially overlapping paths of travel to axially cover the cutting chamber.

Still another object of the invention is to provide an assembly of the character disclosed wherein the knives may be protected by deflecting lobes provided on the shaft mechanism radially between the hammers.

Other objects and advantages of the invention will become apparent with reference to the accompanying drawings and the accompanying descriptive matter.

BRIEF DESCRIPTION OF THE DRAWINGS

The presently preferred embodiment of the invention is disclosed in the following description and in the accompanying drawings, wherein.

DETAILED DESCRIPTION OF THE DRAWINGS

Figure 1:
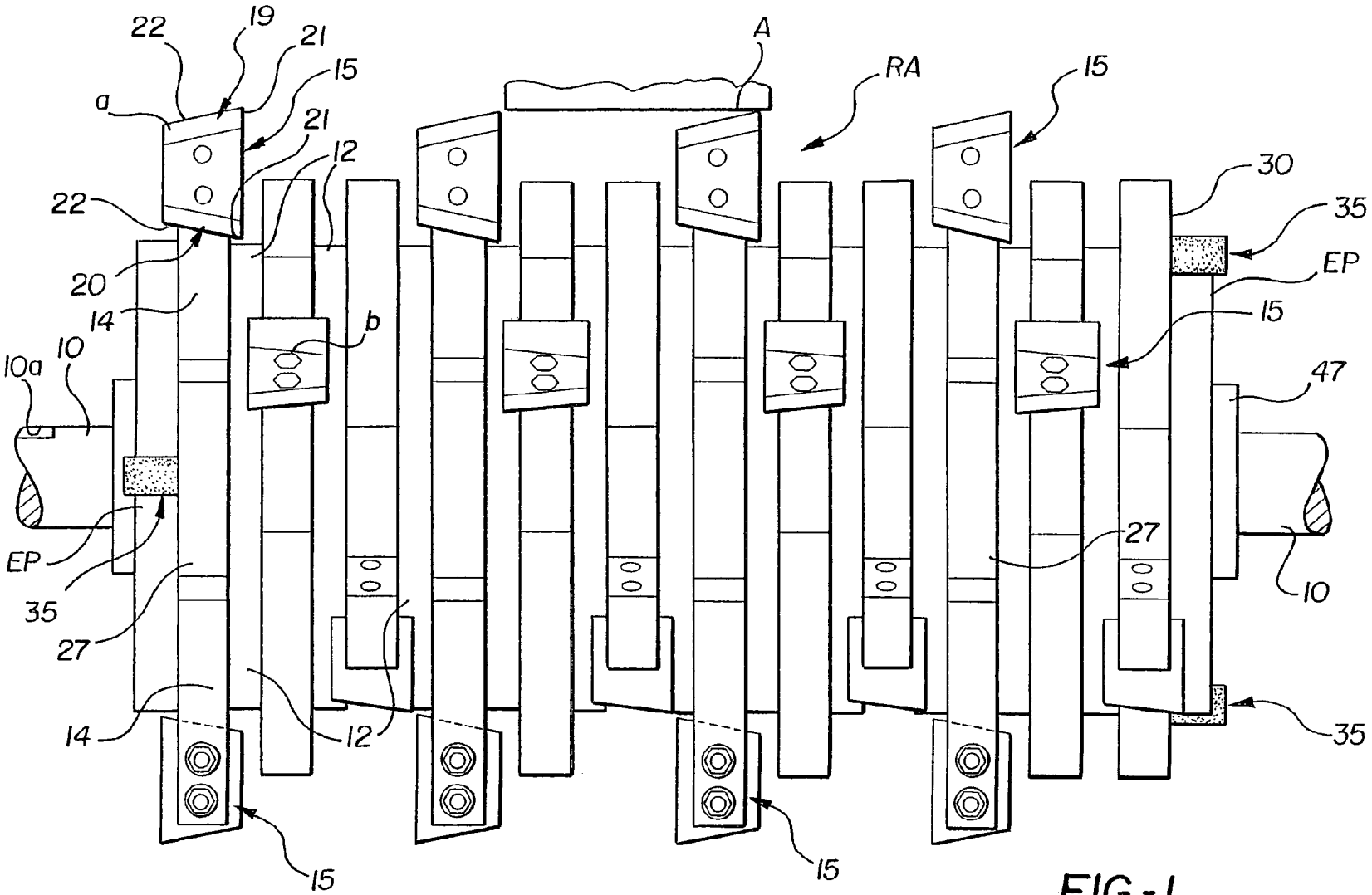
FIG. 1 is a schematic plan view of the rotor assembly.
Figure 2:
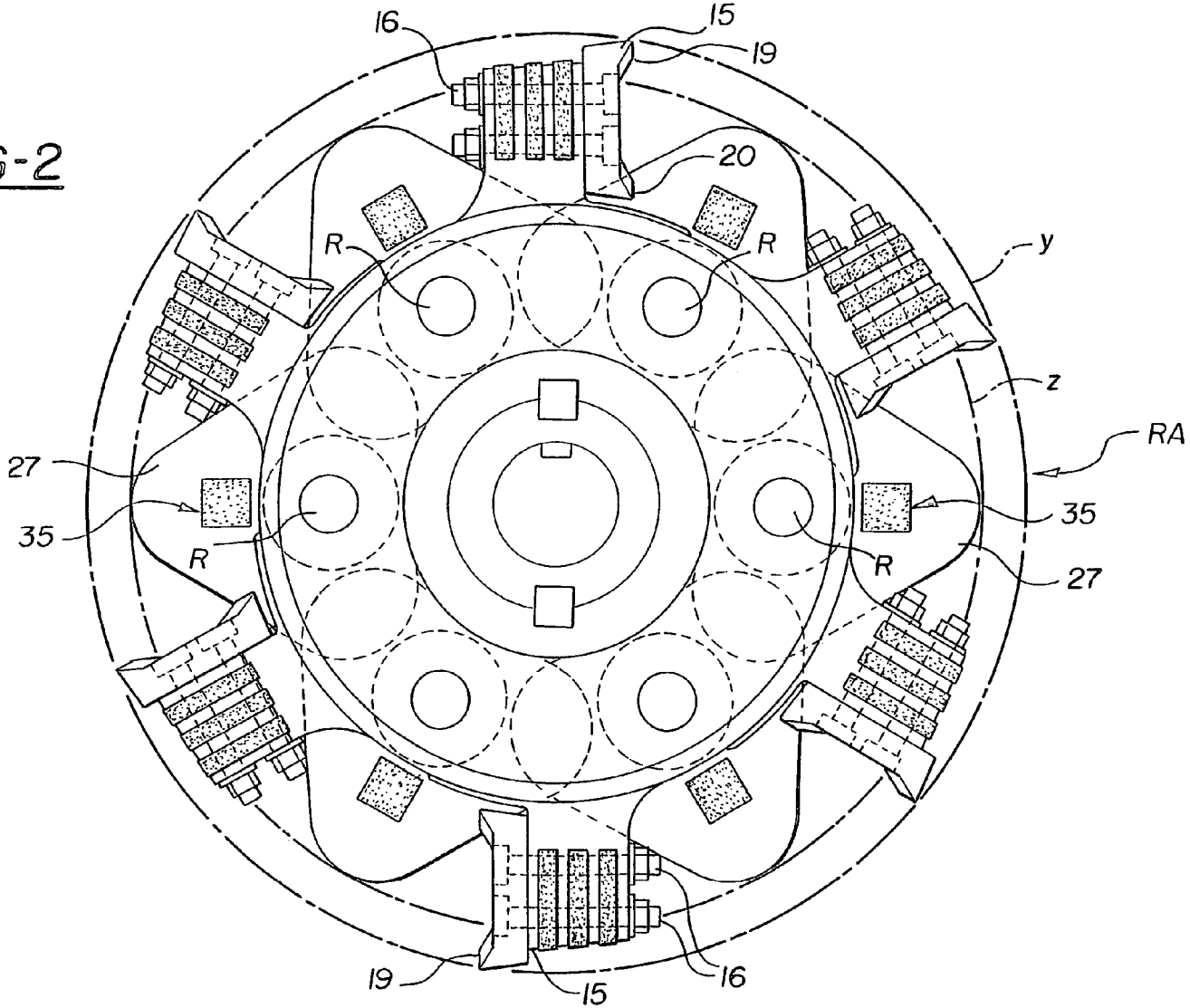
FIG. 2 is an end elevational view thereof.
Figure 3:
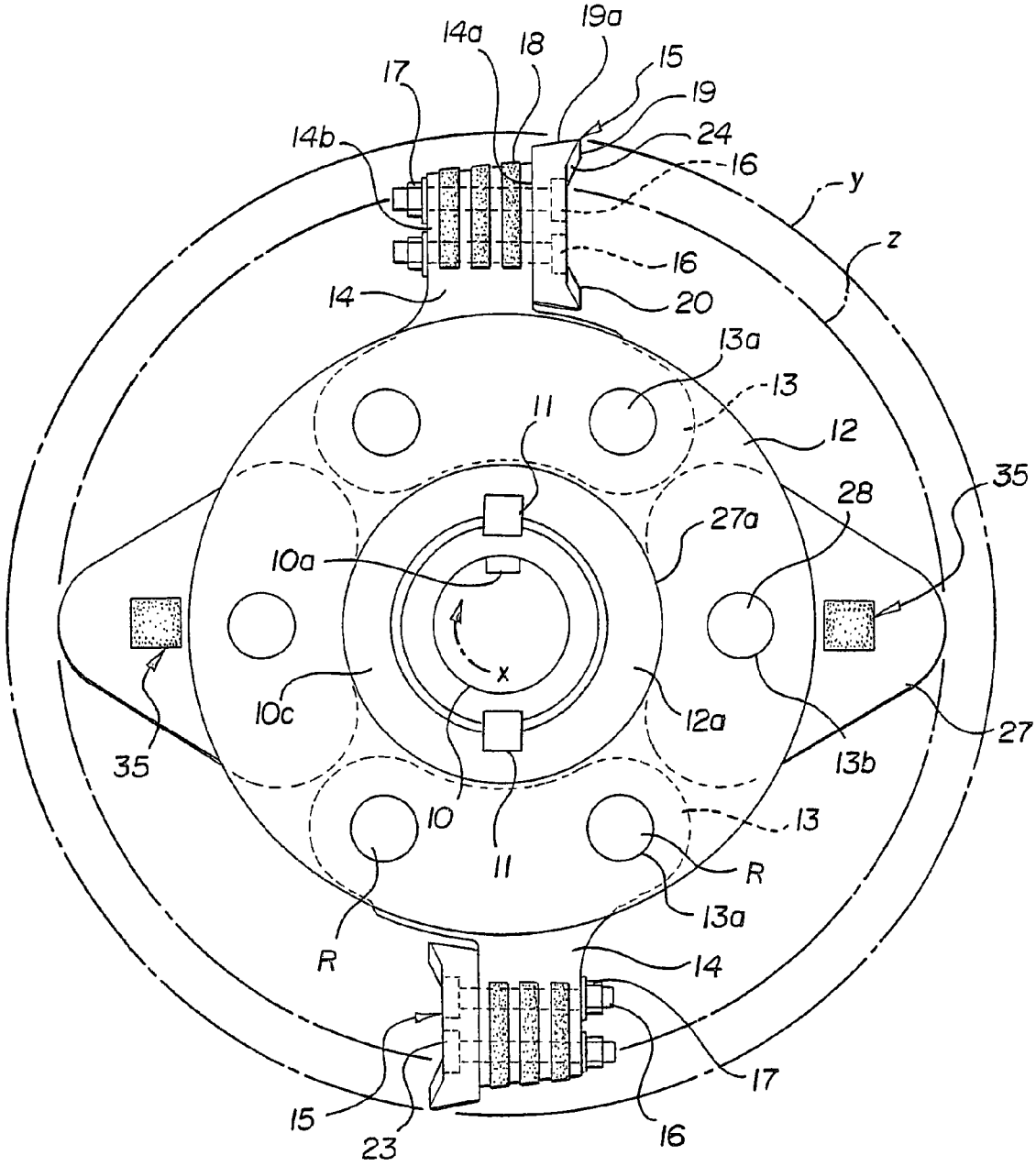
FIG. 3 is a schematic end elevational view of a single rotor disc only with pairs of hammers and lobes mounted thereon.

Referring now more particularly to FIGS. 1–47 of the accompanying drawings and in the first instance to FIGS. 1–3, the rotor assembly illustrated is generally designated RA and comprises a shaft 10 which may have a keyway 10*a* by means of which it is coupled to a drive motor. Typically the drive, in addition to keyway 10*a*, may comprise sprockets and chains, or sheaves and belts, coupled to a drive motor such as a diesel engine. The rotor assembly RA in all embodiments to be disclosed may be employed in either the hammer mill disclosed in the aforementioned U.S. Pat. No. 5,419,402 or the wood hog disclosed in the aforementioned U.S. Pat. No. 5,713,525.

Keyed to an enlarged portion 10*c* of the shaft 10 as, for example, at 11, are the rotors 12*a* for axially adjacent discs or rotor plates 12 between which radially opposite hammer bodies or supports 13 may be mounted on circumferentially spaced axially extending rods R extending through opening 13*a* in the hammer bodies and 13*b* in the discs 12. In the embodiment shown, discs or plates 12 will have six circumferentially-spaced openings 13*b* to snugly slideably receive the mounting rods R. FIGS. 19–22 illustrate the manner in which the rods R are releasably locked in position and will later be specifically described. The hammer bodies 13 (FIG. 3) include cutter mounting, radially outer head portions 14 having leading faces 14*a* extending generally radially to the direction of rotation x of the rotor shaft, and trailing faces 14*b*.

Fragmenting or cutting dual edge knives, generally designated 15, to be later described in more detail, are secured to the hammer heads 14 by suitable fastening mechanism such as a pair of bolts 16 which extend through bolt openings 16*a* in the cutters 15 and 16*b* in the hammer heads 14 to be secured by nuts 17. It will be noted that the hammer head sides and top or outer surfaces are coated with bands of a wear material such as tungsten carbide 18.

Referring now more particularly to FIGS. 1 and 4–7, it will be noted that the cutters, generally designated 15, are provided with radially outer and radially inner fragmenting or cutting edges, generally designated 19 and 20 respectively. The radially outer edges coact with the usual anvil edge A (FIG. 1) to cut and fragment the material. Each of these cutting edges 19 20 includes a radially constant portion 21 (FIG. 4) and a radially inclined portion 22, but, as will be seen, the inclined portions 22 of the respective cutting edges 19, and 20 incline in opposing directions. Typically, the edge portion 21 (FIG. 4) may be a half-inch in length when the overall axial width of the cutter is 4 inches. It will be noted that the cutter body is counterbored as at 23 to receive the heads of bolts 16. The angle of inclination of inclined portions 22 may typically be 12° to the surfaces 21.

Figure 4:
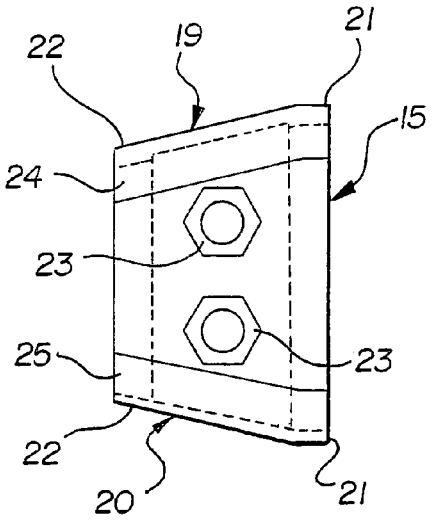
FIG. 4 is a front elevational view of one of the cutter knives only prior to its coating with wear material.
Figure 5:
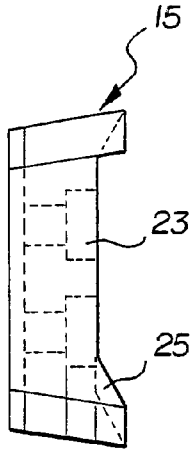
FIG. 5 is an end elevational view thereof.
Figure 6:
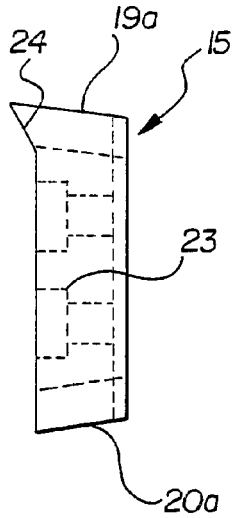
FIG. 6 is an opposite end elevational view thereof.
Figure 7:
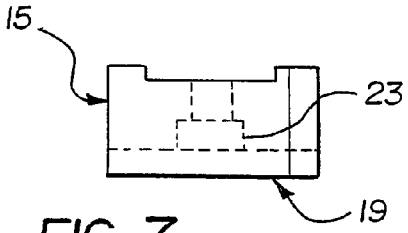
FIG. 7 is a top plan view thereof.
Figure 8:
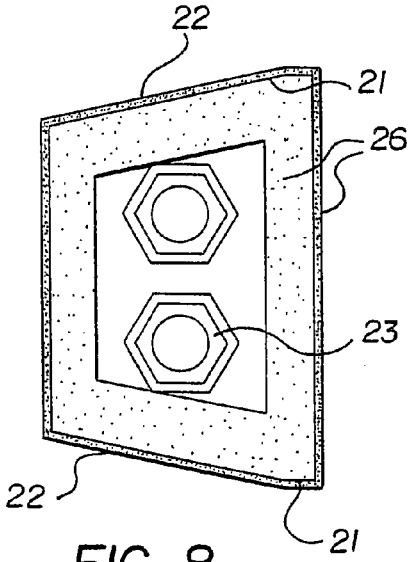
FIG. 8 is a schematic front elevational view of the cutter knife shown in FIG. 4 with the wear surfaces shown as applied thereto.
Figure 9:
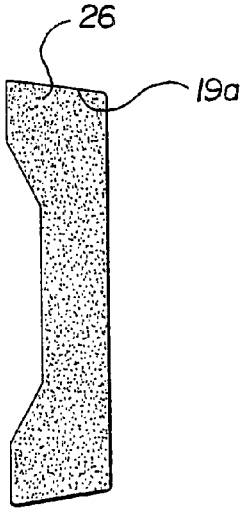
FIG. 9 is an end elevational view thereof.
Figure 10:
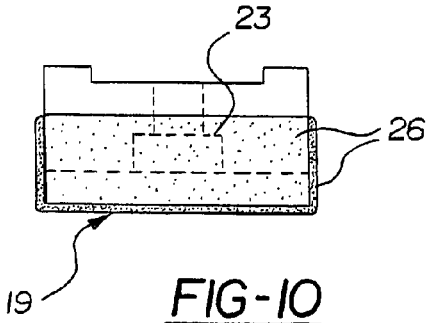
FIG. 10 is a top plan view thereof.

In FIG. 4, the grinding of the edges 19 produces a relief face 24 on the cutter body and the grinding of the edges 20 produces a like face 25. The relief angle of inclination of the faces 24 and 25 may typically be 28°. It will also be seen that the end edges 21 and 20 are relieved as at 19*a* and 20*a* and this angle of relief may typically be 8°. As FIGS. 8–10 indicate, the cutters are also provided with a welded-on wear material which is coated on them as shown in FIGS. 8–10 at 26.

Referring particularly to FIG. 1, it will be noted that the hammers on adjacent discs or rotor plates 12 are offset angularly with respect to one another in helically staggered relation and that the edges 19 and 20 project axially beyond the hammer head portions 14 partially across the intervening spacers 12*a*. Thus, the portions 21 of the edges 19 and 20 on axially adjacent hammer heads at their extreme axially projecting edges revolve in closely adjacent paths of revolution, so that no appreciable space is left between these paths axially. These edges 19 and 20 on the axially adjacent cutters which are circumferentially closest (adjacent) are oppositely inclined as shown at a and b in FIG. 1. Because of this, the wood fragments are not progressively forced axially left or right and tend to remain more uniformly dispersed over the length of the cutter head assembly. It will also be observed that the cutters 15 on the axially aligned hammers 13 have outer cutting edges which incline in opposing directions to provide a more aggressive fragmenting action. In each instance, however, there are inner edges 20 which are basically held in reserve so that, when the time comes, the knives 15 may simply be rotated 180° once the bolts 16 are removed. The former inner edges will then become the outer "working" edges.

Figure 11:
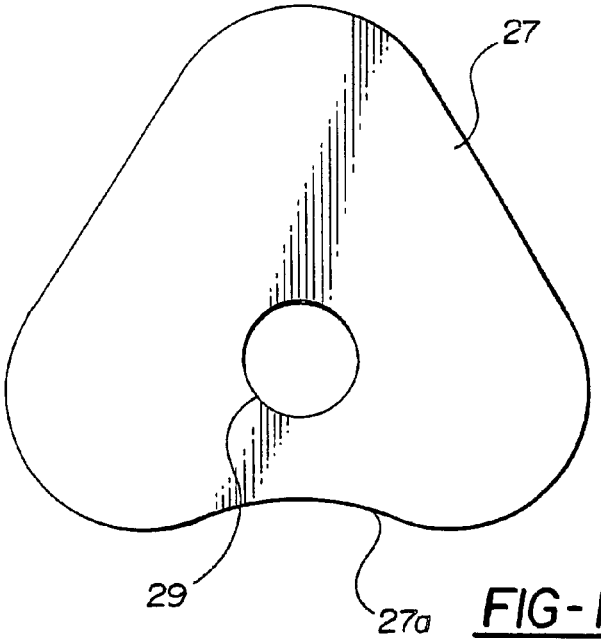
FIG. 11 is a face elevational view of one of the lobes which mount radially between the hammers.
Figure 12:
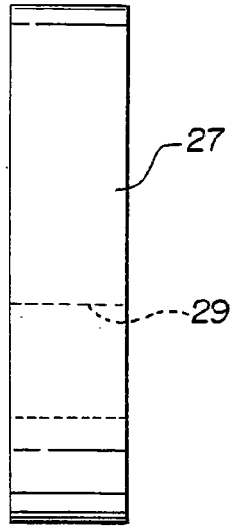
FIG. 12 is an end elevational view thereof.
Figure 13:
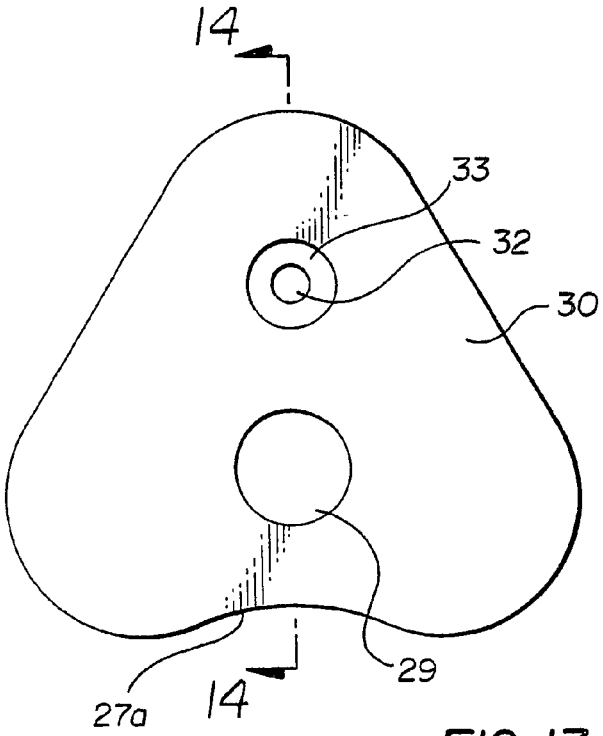
FIG. 13 is a face elevational view of one of the endmost lobes.
Figure 14:
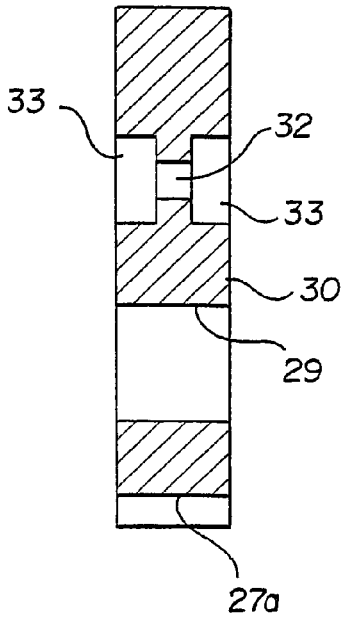
FIG. 14 is a sectional elevational view taken on the line 13—13 of FIG. 13.
Figure 16:
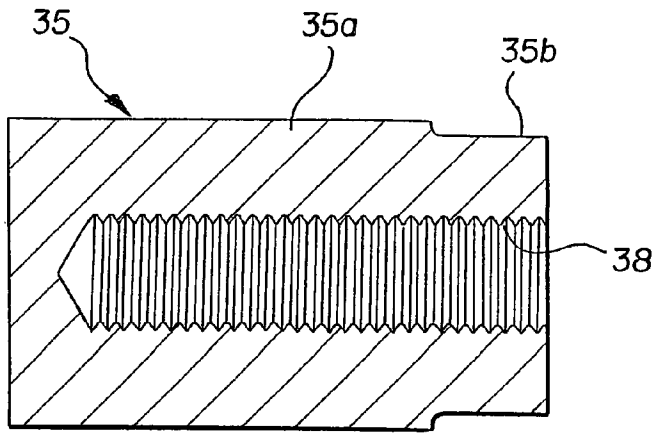
FIG. 16 is a cross-sectional view thereof taken on the line 16—16 of FIG. 15.
Figure 18:
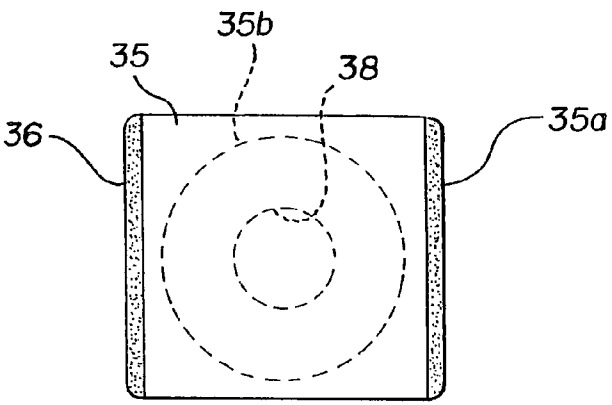
FIG. 18 is an end elevational view thereof.
Figure 15:
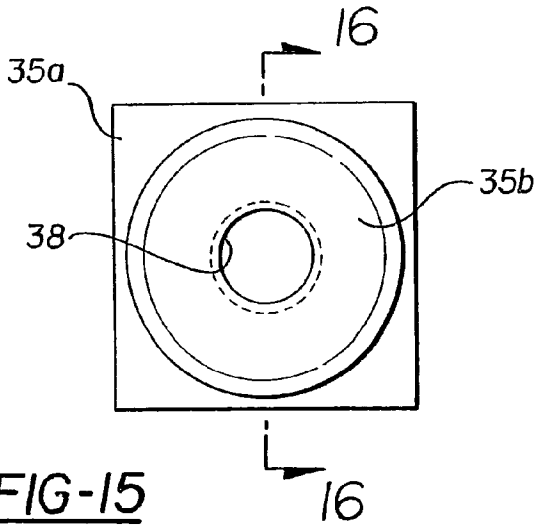
FIG. 15 is an end elevational view of one of the rotor end plate deflect inserts.
Figure 17:
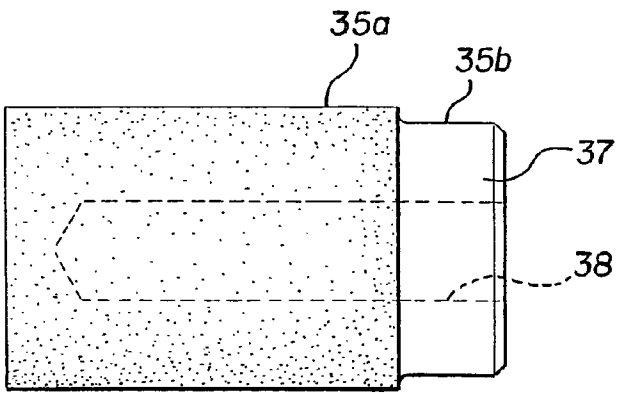
FIG. 17 is a schematic side elevational view of one of the deflect inserts which has been wear material coated.

Lobes or humps 27 of generally delta shape are provided as shown particularly in FIG. 3. These lobes 27 are situated radially between the hammer bodies 13. The inner ends of lobes 27 are curvilinear as at 27*a* to conform to the circumference of the disc hubs 12*a*. As shown in FIGS. 11 and 12, rod openings 29 are provided in the lobes 27. The distance between a rod opening 29 and one of the openings 13*a* is the same as the distance between the pair of openings 13*a* in each hammer 13 so that rods R, mounted or supported by discs or plates 12, mount both the hammers and the lobes in radial alignment, as FIG. 2 indicates.

The interior lobes 27 are configured as shown in FIGS. 11 and 12. The endmost lobes, at each end of the rotor assembly, are designated 30, and likewise have openings 29 to receive and pass the mounting rods R. They also, however, are provided with openings (FIGS. 13 and 14) comprising bores 32 and counterbores 33. Provided to be received in the openings are screening or deflecting inserts, generally designated 35 (see FIGS. 15 through 18), which comprise square shaped bodies 35*a* which have wear surface-coated sides 36 as shown. The bodies 35 have cylindrical portions 35*b* which are received in one of the openings 33 and can be secured by screws extending from the opposing opening 33 and threaded into bolt openings 38 in inserts 35.

As FIG. 1 particularly points out, the purpose of the inserts 35 is to project axially across the rod-locking end plate assemblies generally designated EP and furnish wear material coated surfaces for engaging the work and radially protecting or screening the end plate assemblies EP.

Figure 20:
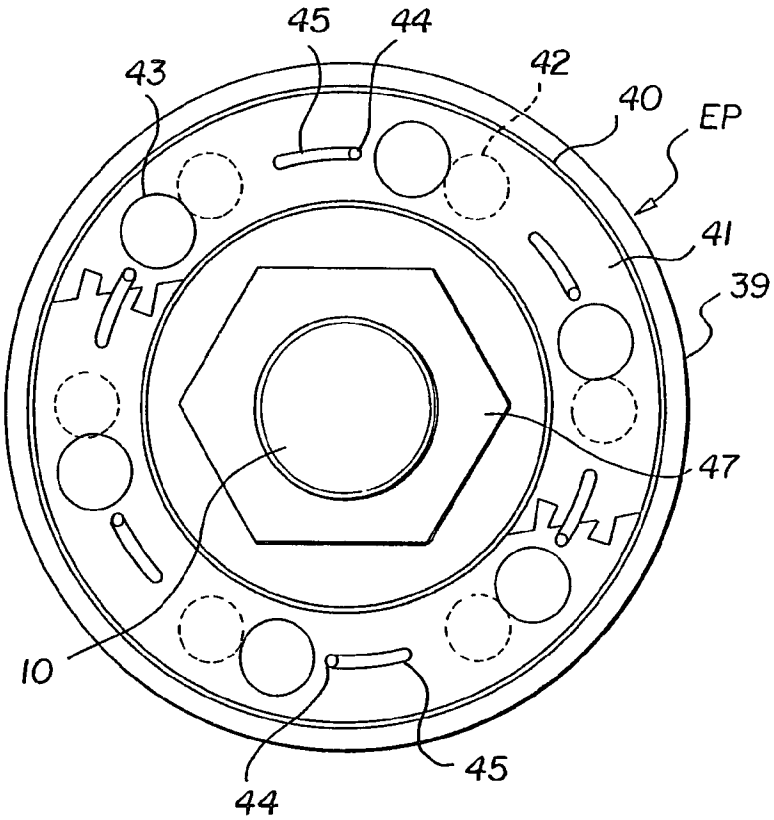
FIG. 20 is an end elevational view thereof.
Figure 19:
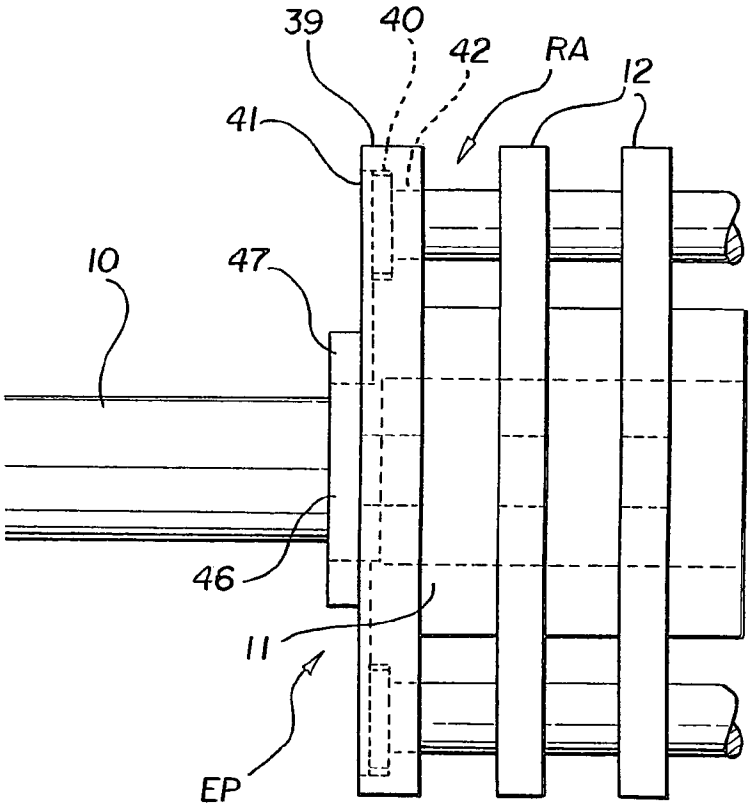
FIG. 19 is a fragmentary plan view of one end of the rotor shaft assembly showing the locking plate in rod locking position, certain parts of the assembly being omitted in the interests of clarify.
Figure 22:
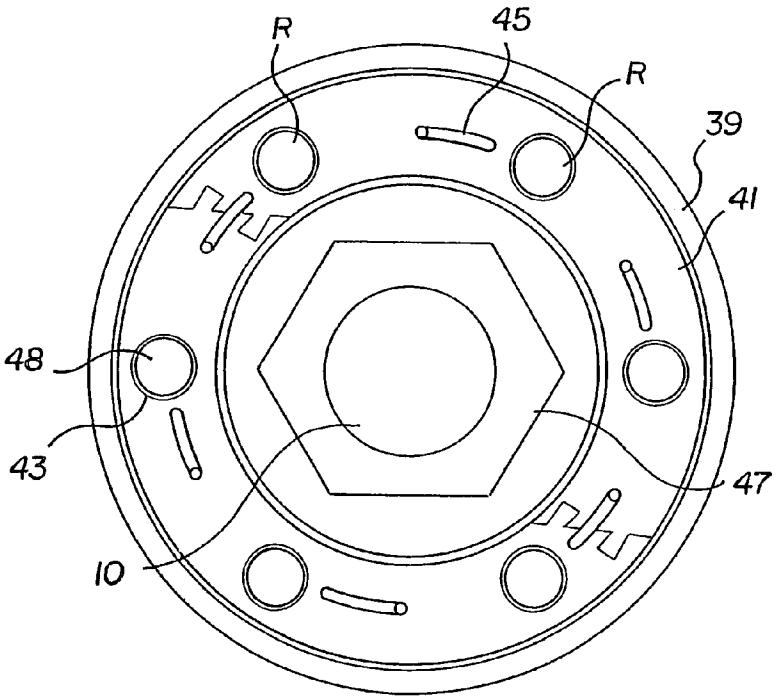
FIG. 22 illustrates an unlocked position of the locking plate.
Figure 21:
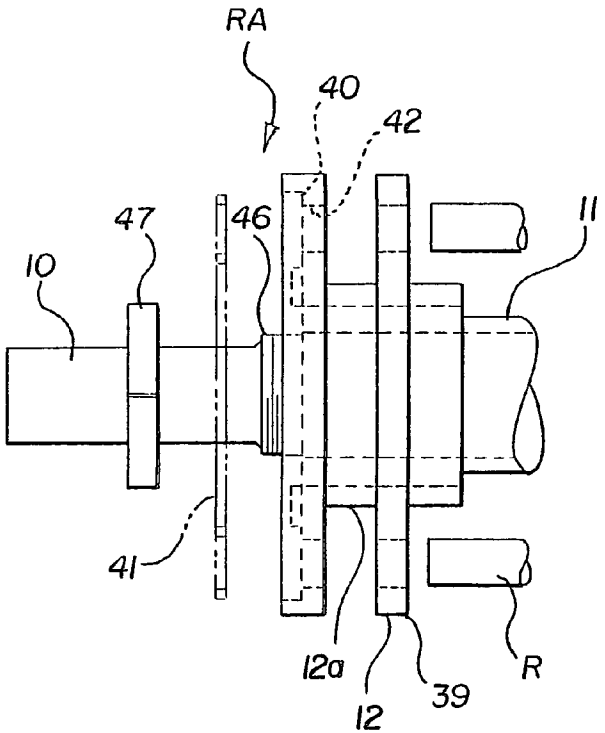
FIG. 21 is an exploded reduced scale plan view of parts illustrated in FIG. 19.
Figure 23:
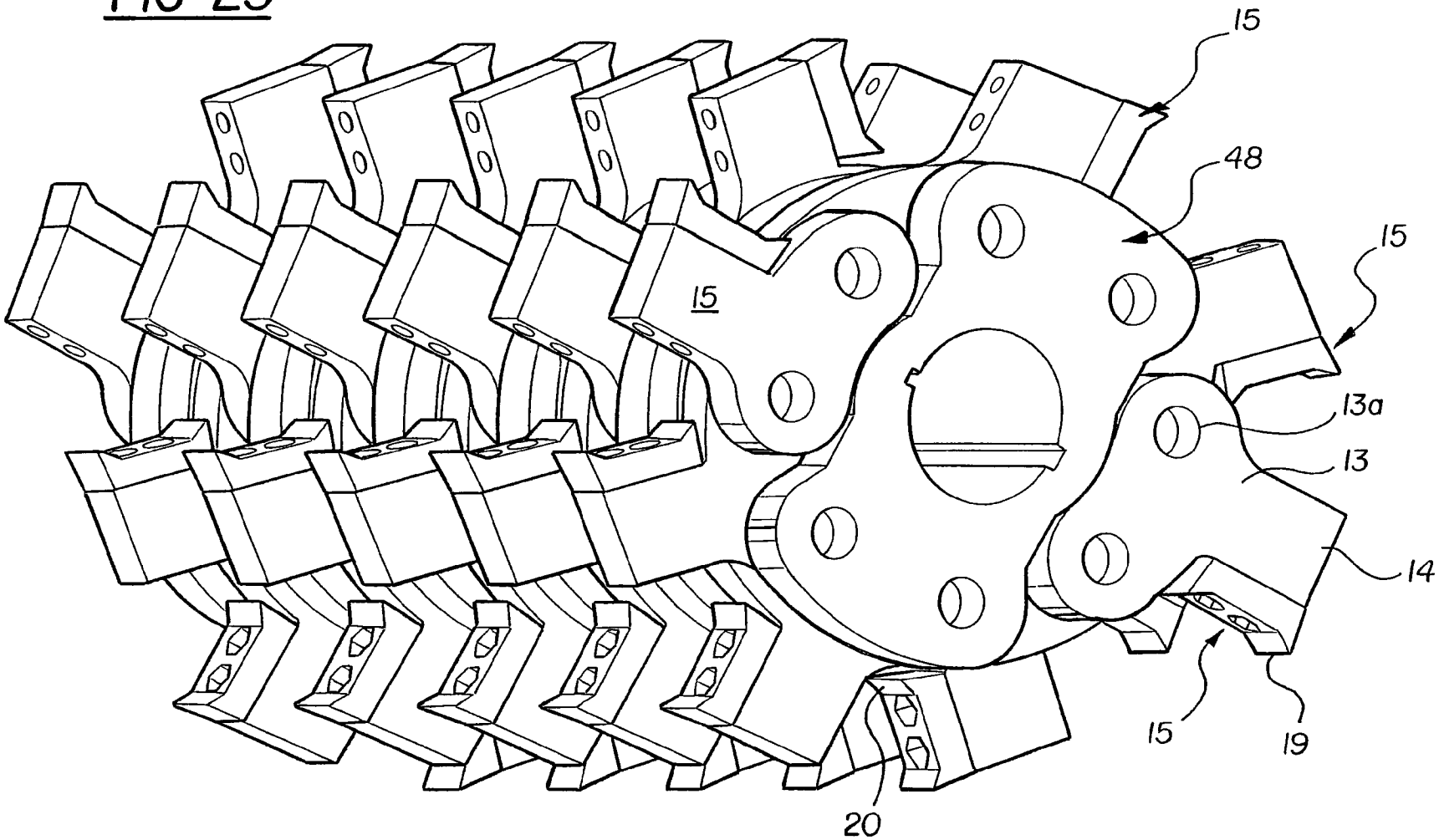
FIG. 23 is a schematic side elevational perspective view of a modified rotor assembly, certain parts being omitted in the interests of clarity.
Figure 26:
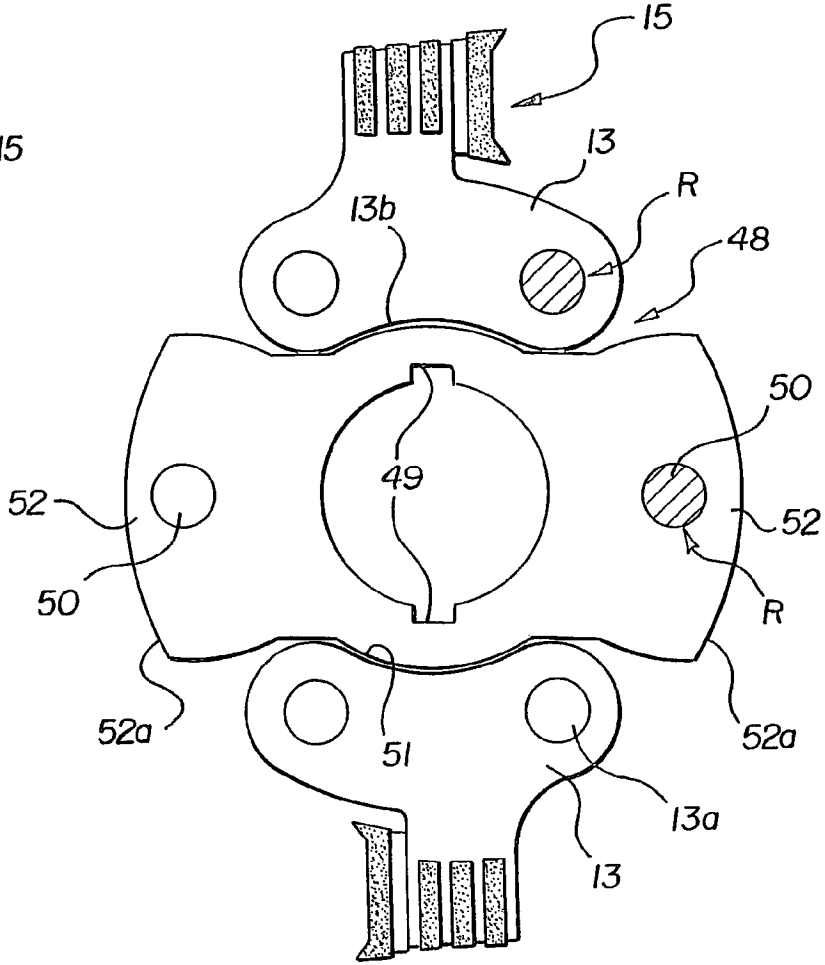
FIG. 26 is a fragmentary end elevational view of one of the rotor disc assemblies only.
Figure 24:
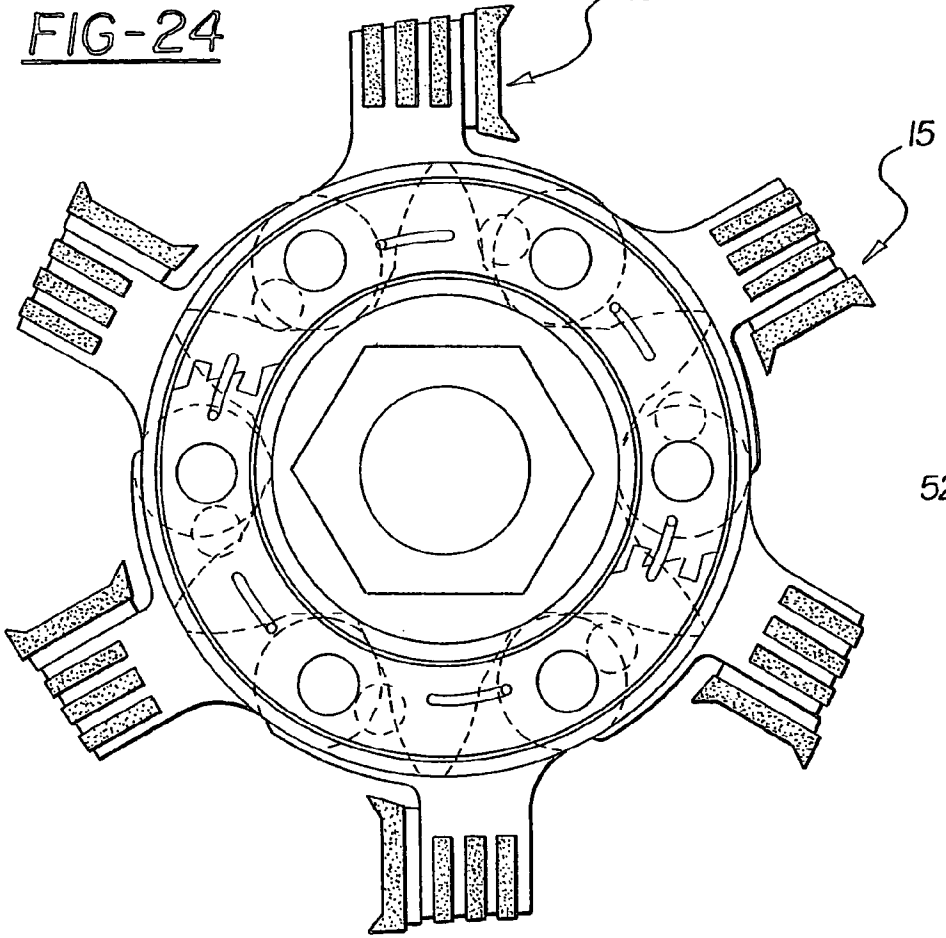
FIG. 24 is an enlarged end elevational view.

Referring now to FIGS. 19–22, each end plate assembly EP includes an end plate 39 having an outwardly facing cavity or recess 40 in which a locking plate or ring disk 41 is received for limited rotary adjustment. The end plates 39 have bores 42 for passing rods R and locking plates 41 having identically circumferentially spaced bores 43 which in the rod-releasing position (FIG. 22) can be aligned with bores 42. FIG. 20 illustrates a rod-locking position in which the locking plates 41 have been rotated slightly to block endwise removal of the rods R. Circumferentially spaced bolts 44 projecting endwisely through end plates 39 also pass through arcuate slots 45 and have nuts to fix the rotary adjustment of the locking plates 41. It will be seen that the ends of shaft 10 have threaded portions 46 which releasably receive lock nuts 47 for fixing the plates 39 in locked position.

In operation, the assembled rotor assemblies are provided in either a wood hog or a hammer mill, such as a tub grinder hammer mill, for example, and driven in the direction of rotation x. When the outer radial edges 19 of the cutters 15 require resharpening, the bolts 16 are removed and the cutters 15 are turned end-for-end to dispose the former inner edges 20 radially outwardly. Obviously, other cutters 15 will be carried in inventory so that the need for trips to the cutter resharpening station is minimalized. The cutting edges 19, which are outermost and incline in opposite directions on radially in-line hammer heads 14, provide an aggressive cut in a fragmenting operation which is not as well achieved if the edges have no inclined portions 22. With the provision of portions 21, however, there are no points to be readily worn or rounded, as if the edges 22 were to extend from end-to-end of the cutters 15.

The paths of rotation of the outer knife cutting edges is shown at "y" in FIG. 3. The paths of the outer edges of the lobes or deflectors 27 is shown at "z". It is to be noted that the outer edges of lobes 27 traveling in the paths "z" radially protect the inner edges 20 of each cutter knife 15 during operation, along with also protecting or screening the bolts 16 which hold the cutters 15 in fixed position. Because of the disposition of the lobes 27 on discs 12 in the same radial plane as the knives, wood fragments which might otherwise impinge upon the inner edges 20 and the bolts 16, are deflected in substantial part by the deflector lobes 27.

A further assembly, which is modified in several respects, is disclosed in FIGS. 23–27. Where the parts or assemblies are substantially the same as previously described, the same numerals and letters have been used to designate them.

Figure 25:
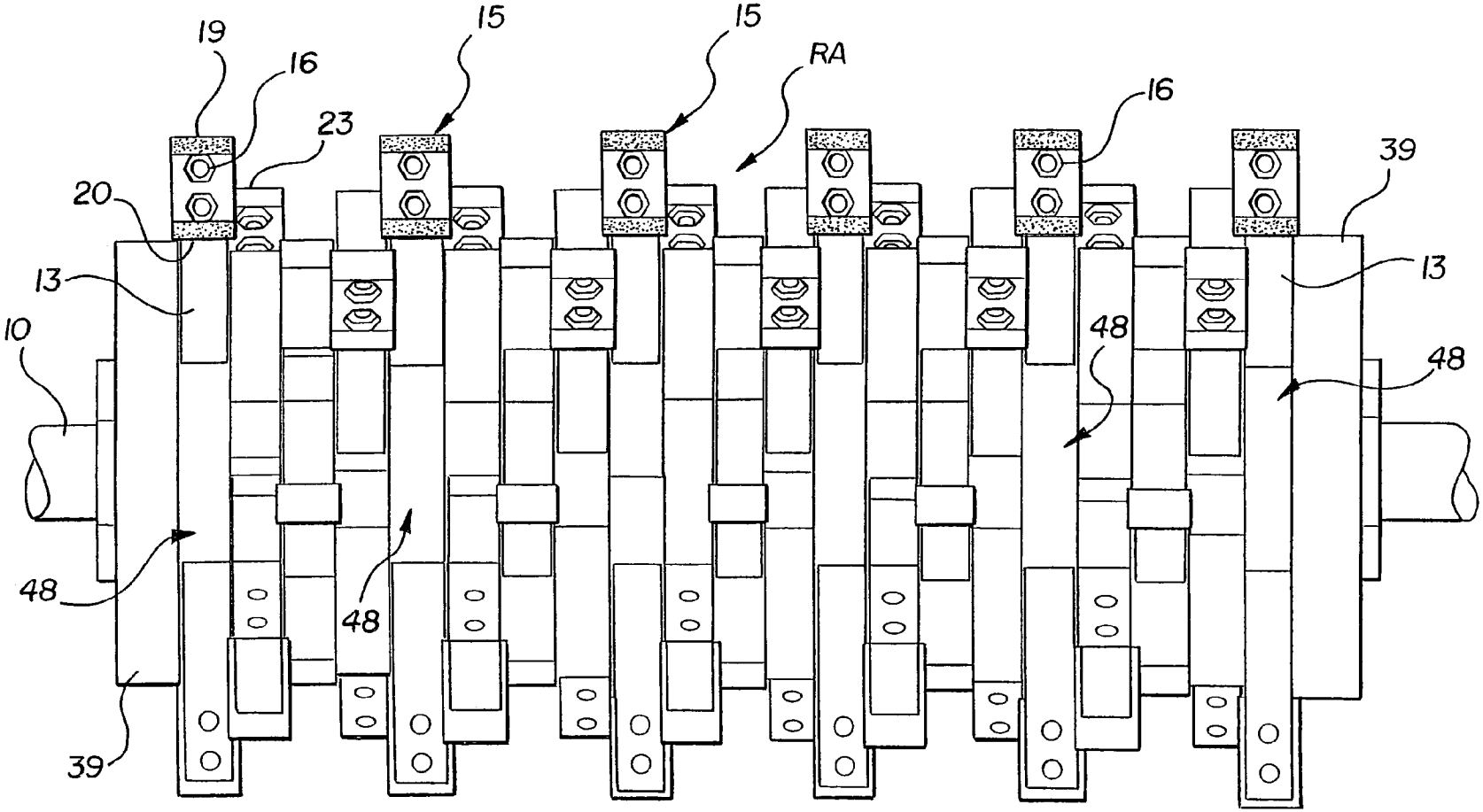
FIG. 25 is a plan view.

In FIG. 25, for example, the overall rotor assembly is similar to the rotor assembly RA disclosed in FIG. 1, and the hammer assemblies 13 are identical. The rotor assembly RA operates in conjunction with an anvil A of the character disclosed in FIG. 1 and rods R, as previously, are used to mount the hammer bodies 13 and associated knives 15, in assembled position. The hammer body openings 13*a* are, as previously, provided along a circle "c" having a constant radius taken from the axis of shaft 10. In the rotor assembly of FIGS. 23–27, however, there are no rotor plates 12 and, as FIG. 25 indicates, the fragmenting and cutting edges 19 and 20, which are provided on hammer heads 13, project axially beyond the hammerhead portions 14 to partially axially lap one another. The edges 19 and 20 on the axially adjacent cutters, which are circumferentially closest (adjacent), are not inclined. The cutter head assembly RA, as previously, includes the rod-locking end plate assemblies EP, including end plates 39 which mount the ends of rod R and the locking plates 41 which lock the removable rods R in position.

In the prior described rotor assembly, the lobes or humps 27 of generally delta-shape have curvilinear surfaces 27*a* which are received by the disc hubs 12*a*. In the present case, the delta-shaped lobes are replaced by dual deflector lobe members, generally designated 48, having keyways 49 or 53, which may secure them on the shaft 10 by way of appropriate keys. Rods R similarly extend through the openings 50 provided in 180° spaced apart relation along circle "c" in the members 48. It will be noted that the members or deflectors 48 are shaped such as to provide curvilinear surfaces 51 which match the curvilinear surfaces 13*b* of the hammer bodies 13 on which they are received, and that the screening members 48 are also provided with radially outer lobes 52 having outer peripheral deflecting surfaces 52*a*. The deflector lobe members 48 have substantially the same axial width as the hammer bodies 13 and it will be noted that the peripheral surfaces 52*a* have the path of rotation previously identified by the letter "z" in FIG. 3 and radially protect the inner edges 20 of each cutter 15 during operation, along with also protecting or screening the bolts 16 which hold the cutters 15 in fixed position.

Figure 27:
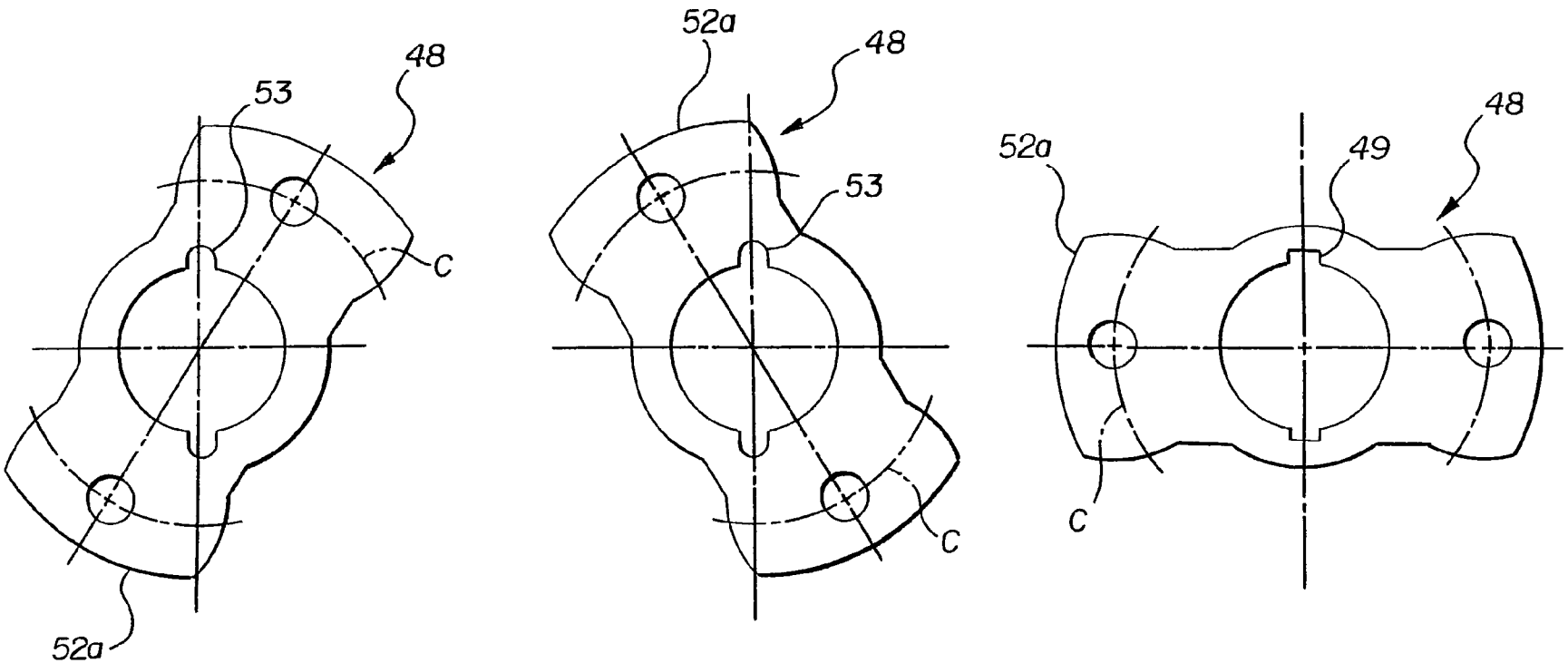
FIG. 27 is a reduced size end elevational view showing deflector elements in the angular relationship in which they are used in the rotor assembly.
Figure 30:
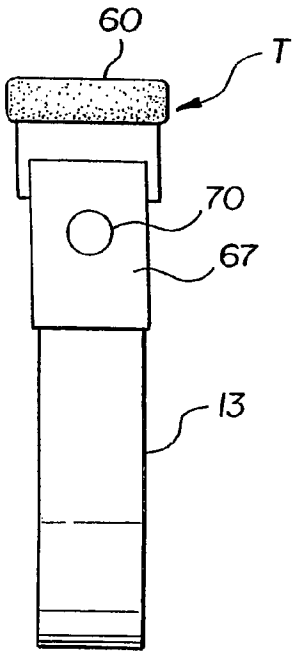
FIG. 30 is a front elevational view.
Figure 29:
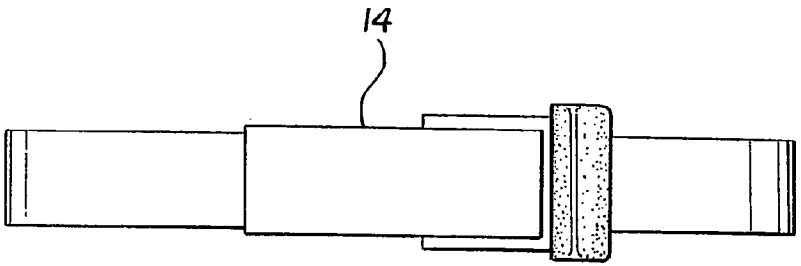
FIG. 29 is a top plan view thereof.

FIG. 27 illustrates the staggered relationship of axially successive deflector lobe members 48. It will be noted that the parts 48 are identical, with the exception that the horizontal disposed member or element 48 at the right end of FIG. 27 differs in the configuration of its keyways 29 from the keyway shapes 53 shown in FIG. 27, which, of course, require axially extending keys of the same configuration to mount them on the shaft portions 10*c*.

In operation, the cutter head assembly, disclosed in FIGS. 23–27, may also be used in either a wood hog or a hammermill, with the hammer bodies operating in exactly the same manner as previously. With the circumferential path of rotation of the surfaces 52*a*, wood fragments which would otherwise impinge upon the inner edges 20 and the bolts 16 are deflected in substantial part by the dual deflector lobe members 48.

FIGS. 28–37 are directed to another hammer knife assembly in which, again, like parts have been identified by the same numerals and letters as previously. In this construction, the front or leading face of each hammer head 14, generally designated 54, is formed with a radially inwardly inclined support surface 55 (FIG. 31) which, for example, can extend at an angle of 125° to the vertical in this figure. A tool base supporting surface 56 leads from surface 55 and can extend at 90° to the surface 55 in FIG. 31. The recessed configuration 54 also includes a vertical surface 57 in FIG. 31, and a clamping surface 58 which, for example, can extend at 128° to the surface 57.

Figure 28:
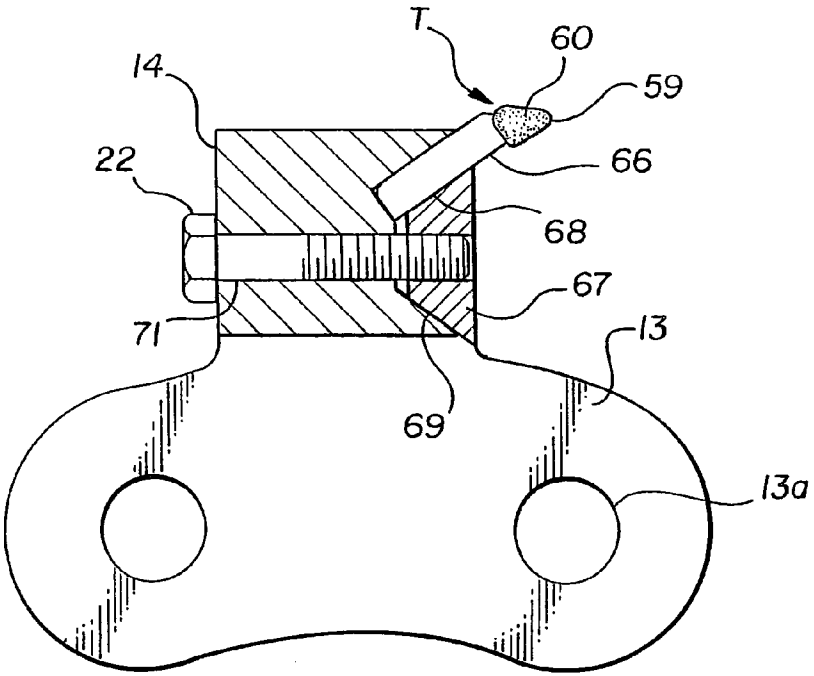
FIG. 28 is an enlarged side elevational view illustrating another embodiment of a hammer and knife assembly.
Figure 31:
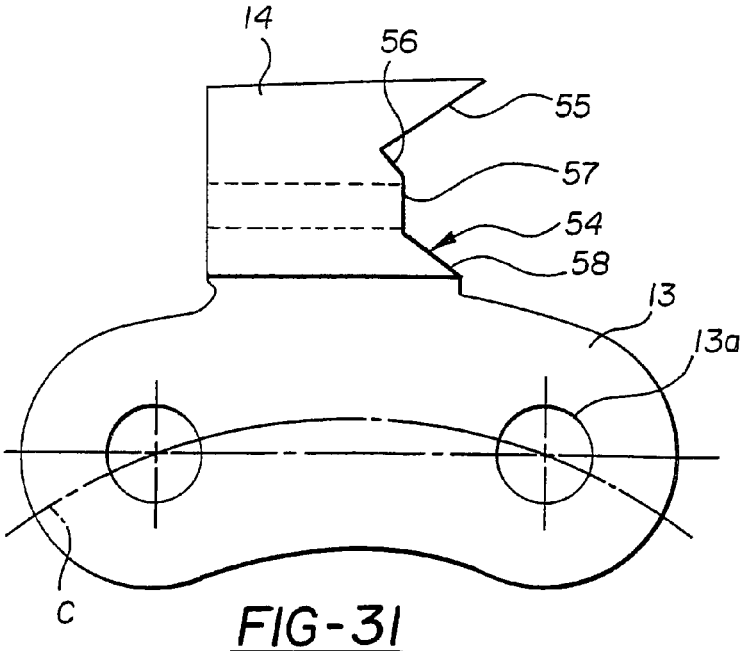
FIG. 31 is an enlarged side elevational view of the rotor body only.
Figure 32:
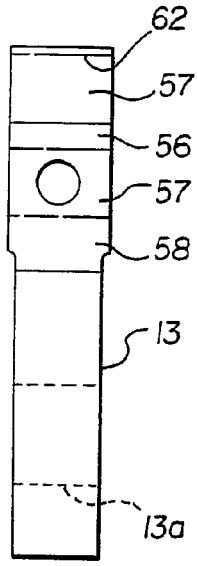
FIG. 32 is a front elevational view.
Figure 33:
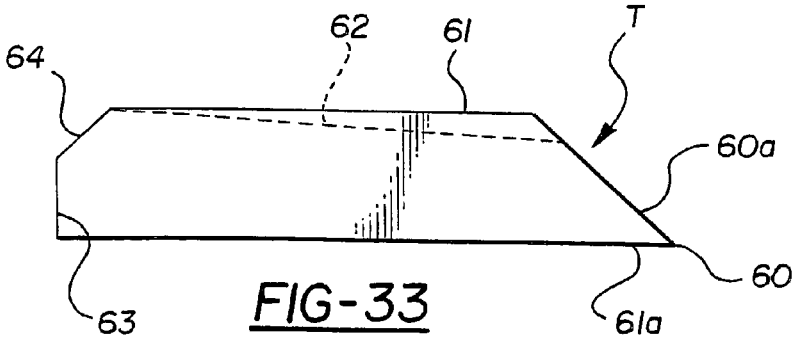
FIG. 33 is an enlarged side elevational view of the knife employed, prior to application of its front end surface coating.
Figure 34:
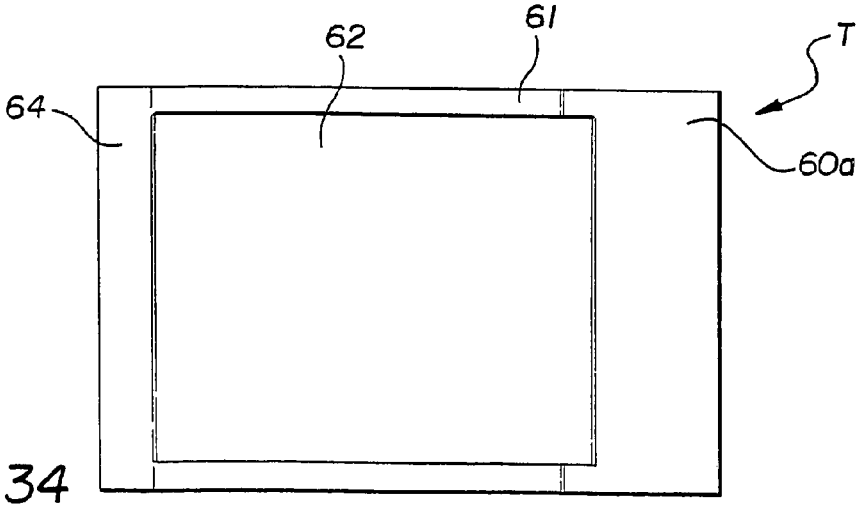
FIG. 34 is a top plan view thereof.

As FIG. 28 illustrates, it is the surfaces 55 and 56 which receive the fragmenting or cutting tool, generally designated T, which is provided with a hard surfaced coating 59 for cutting tool edge 60. FIGS. 33 and 34 illustrate the configuration of the cutting tool T prior to coating, which is shown as a tool bar in FIGS. 33 and 34 which is cut away at an angle of, for example, 45° from its upper surface 61 as at 60*a* to define the uncoated cutting edge 60. It will be noted that the upper surface 61 of tool bar T is recessed as at 62 at an inclined relief angle of about, for example, 3° from the surface 61 and that the base end wall 63 at its upper end is relieved as at 64.

Figure 37:
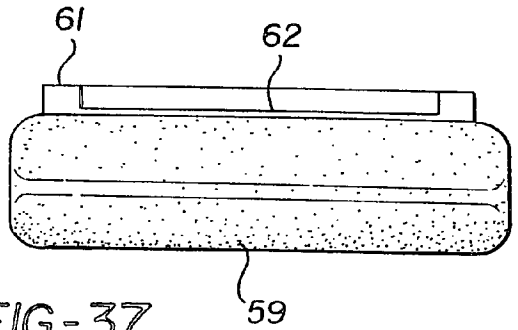
FIG. 37 is a front end elevational view.
Figure 38:
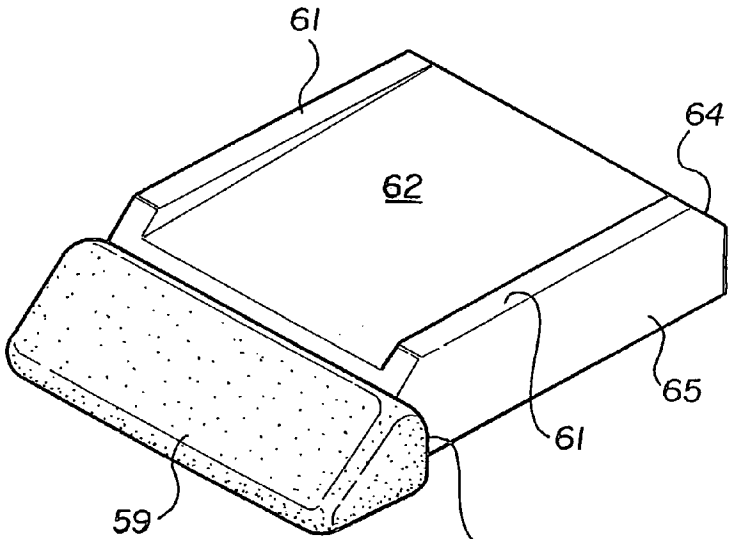
FIG. 38 is a fragmentary perspective view.
Figure 35:
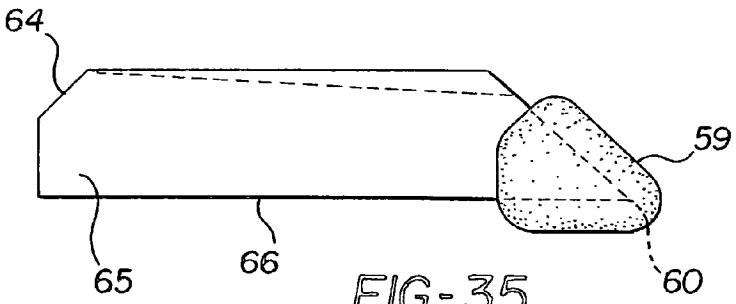
FIG. 35 is a schematic side elevational view of the knife after application of the coating to its front end.
Figure 36:
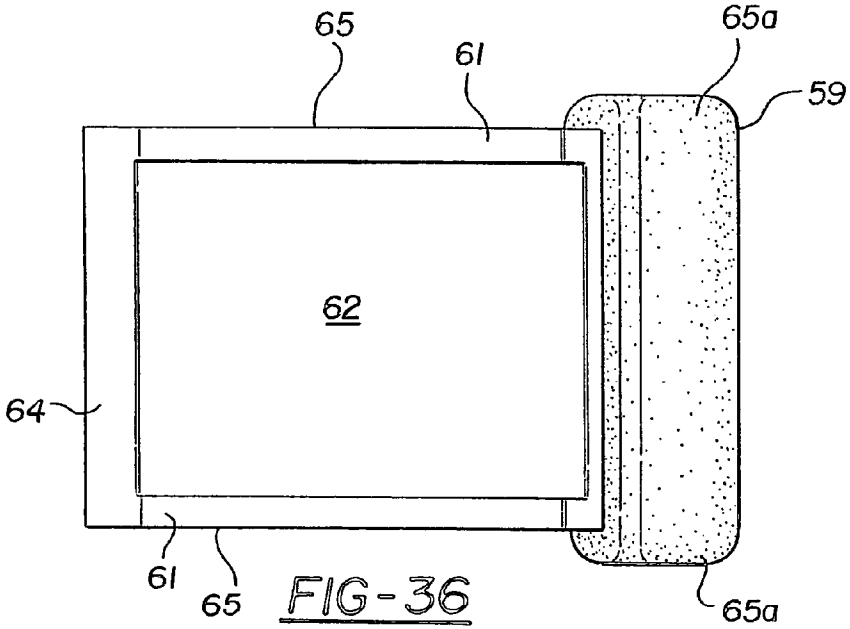
FIG. 36 is a top plan view thereof.

The hard tungsten carbide, or other suitable hard surfaced material, which is applied to the face 60*a* and cutting edge 60, as shown in FIGS. 35–38, is about one-eighth inch in thickness. As shown in FIG. 35, it coats a major portion of wall surface 60*a* and the front end of bottom surface 66 to protrude from each. It, likewise, as shown in FIGS. 36 and 37 projects laterally beyond the side walls 65 of the tool bar as at 65*a*. It is the flat outer surface 66 of the toolbar, which is engaged by the wedge plate 67 (shown in FIGS. 28 and 30). Plate 67 has oppositely disposed, similarly inclined wedging surfaces 68 and 69, which respectively engage the toolbar face 66 and the hammer head surface 69 to wedge the toolbar T in rigidly fixed position. A threaded opening 70, provided in wedge plate 67, aligns with a bolt opening 71 through head 14 to receive a bolt 72 which, when revolved in one direction, draws the plate 67 inwardly to tightly clamp toolbar T in position.

In operation, the toolbar T aggressively attacks the wood debris being fragmented or reduced as the rotor assembly RA is revolved at a rapid rate of speed. By loosening bolt 72 and rotating it in the opposite direction, wedge plate 67 may be backed off to permit the ready substitution of a replacement tool T, when wear makes it necessary.

FIGS. 39–47 illustrate a still further modified rotor assembly. Where the parts or assemblies are substantially the same as previously shown and described, the same numerals and letters have been used to designate them. As before, the rotor assembly RA operates in conjunction with an anvil (not shown). Its drive shaft 10 is shown as journaled in frame supported bearings B supported by machine frame F, and as being driven by a sheave element, generally designated SH, configured to receive motor drive belts in the usual manner. While not previously shown in the drawings, it is to be understood that all of the rotor assemblies shown herein may be journaled and driven in the manner disclosed in FIG. 39.

Fixed in axially spaced relationship along the shaft 10 are a series of rod-supporting rotor members which may take the form of discs, for example, and which are generally designated 72. As FIG. 40 indicates, the hammer supports or legs 14 are provided in 180° spaced relation axially adjacent each of the discs 72, on the rods R, which are replaceably mounted as previously disclosed. In the present instance, however, there are a total of 8 rods disposed in 45° apart circumferential relationship. The rods R are locked in position by the elements disclosed in FIGS. 19–22.

Figure 41:
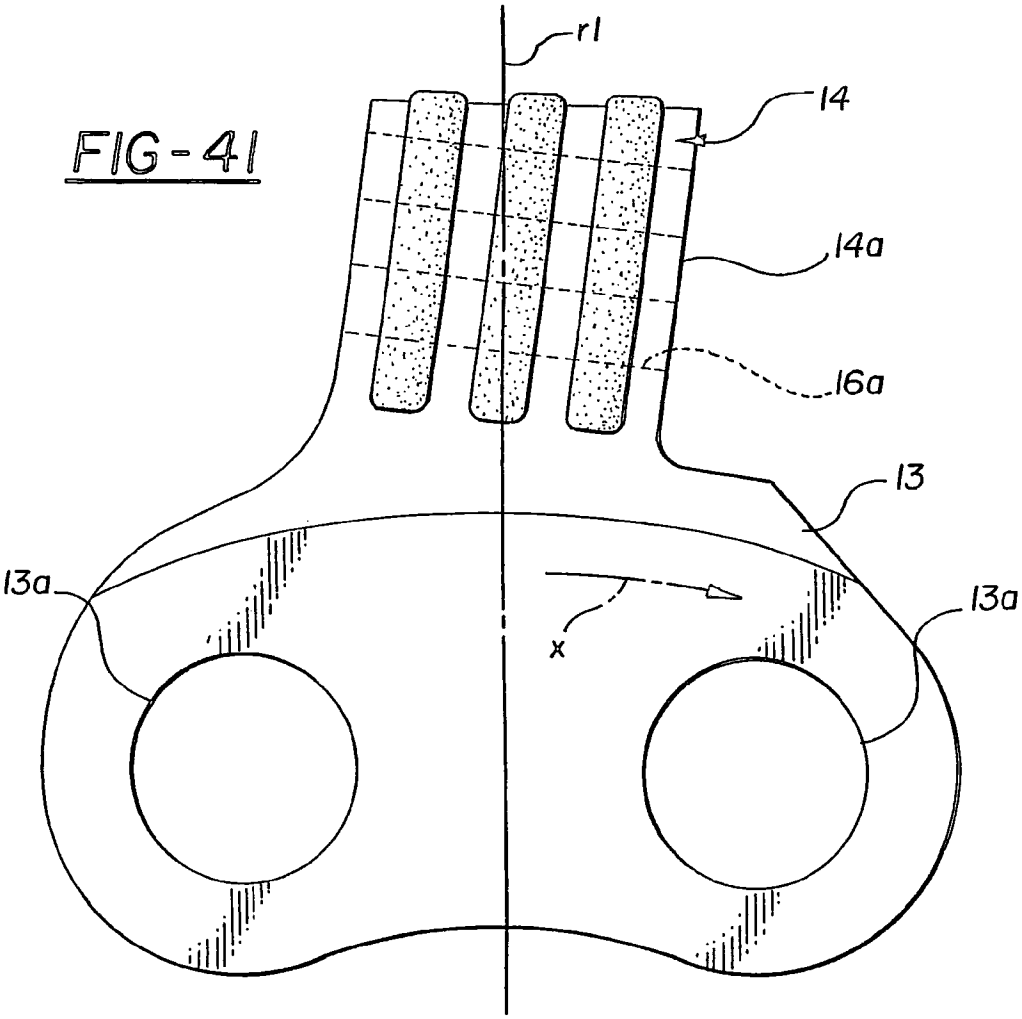
FIG. 41 is an enlarged side elevational view of a modified hammer head used on one side of a rotor disc.
Figure 43:
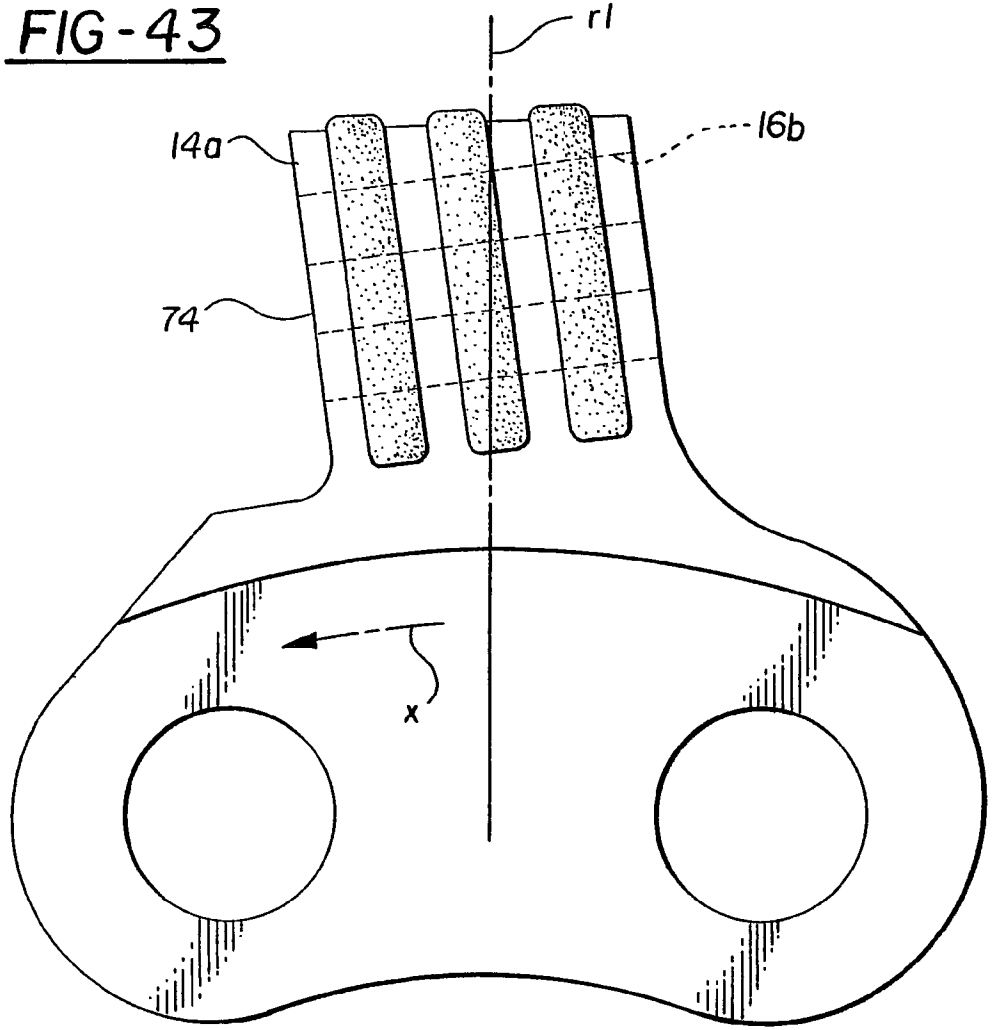
FIG. 43 is a view similar to FIG. 41 of the hammer head used on the other side.

The hammer supports or bodies 14 and knife structures 15 may be of the same constructions as previously set forth in any of the drawing figures with the salient difference in this embodiment, however, that the head portions 14 tilt forwardly, with respect to a radial line rl extending from the axis of rotation "r", in the direction of rotation of the outer knife edge 19. This forward tilt can be readily ascertained by comparing the radial line rl shown in FIG. 40 with the like radial line rl shown in FIG. 41. FIGS. 41 and 43 particularly illustrate this configuration wherein the head portions 14 of the hammers extend at an angle with respect to the hammer body portions 13. It has been found that with the hammer head in effect tilting forwardly as disclosed a more aggressive bite is obtained by the tilted knife edges. With respect to the hammer heads disclosed in FIGS. 41 and 43, it is to be noted that the body portions 13 include curvilinear shoulders 73 offset an amount Q to mate with the periphery of discs 72 and that the angle of inclination of the leading face 74 of each of the heads 14 of the modified embodiment extends at substantially an angle of 7° to the radial line rl. Otherwise, the hammer heads remain effectively the same as those disclosed in the first embodiment of the invention.

Figure 45:
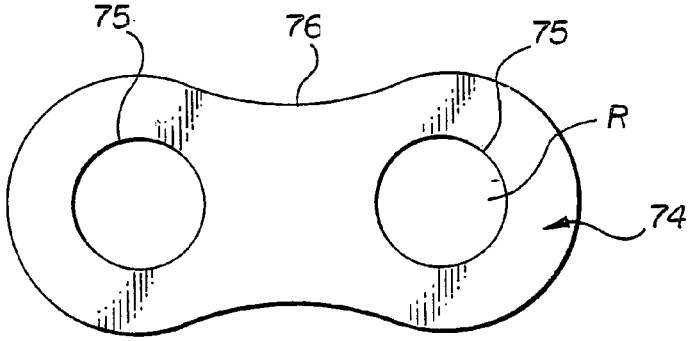
FIG. 45 is an enlarged side elevational view of a modified spacer screening element.

In FIG. 45, a modified form of deflector element or member is disclosed generally at 74. The element 74 may be referred to as generally chain-link configured, and includes openings 75 permitting its mounting on a pair of the circumferentially adjacent rods R in the axial spaces between rotor discs 72 in radial alignment with hammer legs mounted radially outwardly of the discs 72 on rods R. Element or member 74 also includes arcuate surfaces 76 for enabling it to clear the shaft 10. One of the members 74 is shown schematically in position in FIG. 39. It is to be appreciated that each of the pairs or sets of hammers which are essentially of any of the configurations described herein, are disposed 180° apart in the spaces between discs 72 as shown and are successively helically staggered axially. Thus, the position of the respective hammers shown in FIGS. 39, 46, and 46A, in which true axial knife overlap is indicated, is never reached. These figures are included to illustrate knife path overlap.

Figure 39:
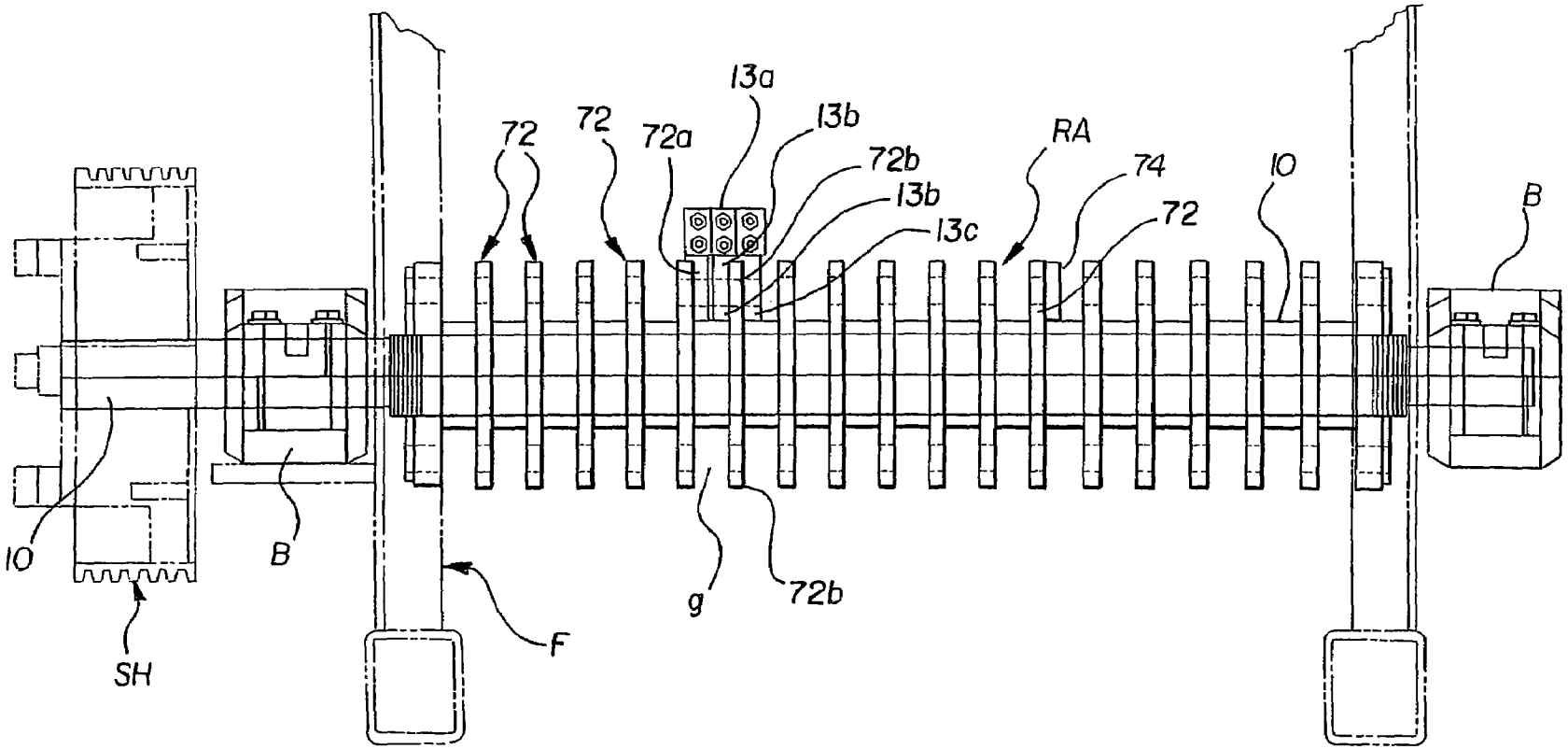
FIG. 39 is a fragmentary schematic plan view of a modified rotor assembly with hammers shown out of position to illustrate how the paths of the knives axially overlap in rotary travel.
Figure 40:
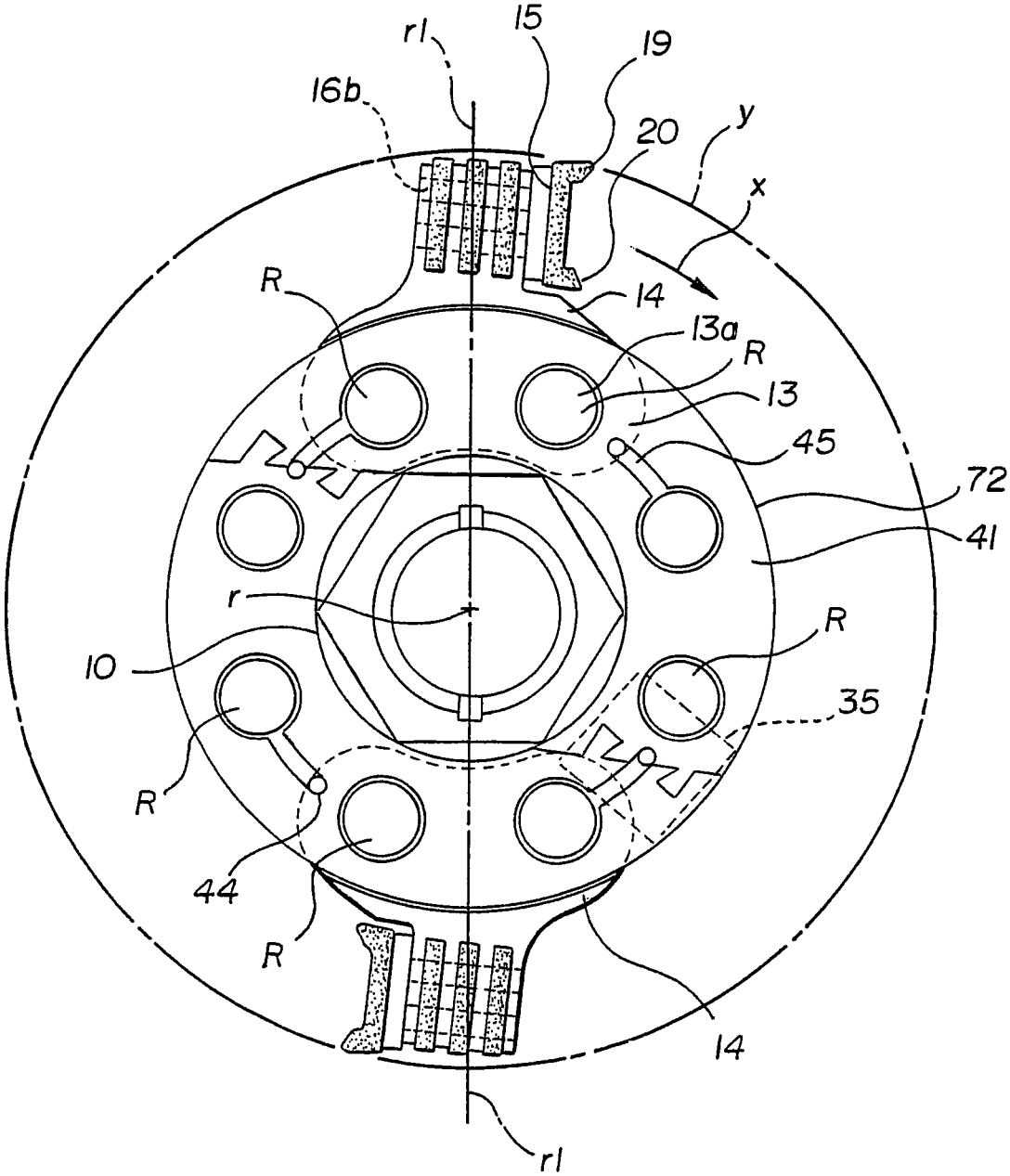
FIG. 40 is an enlarged schematic fragmenting end elevational view showing only a set of hammer heads.
Figure 42:
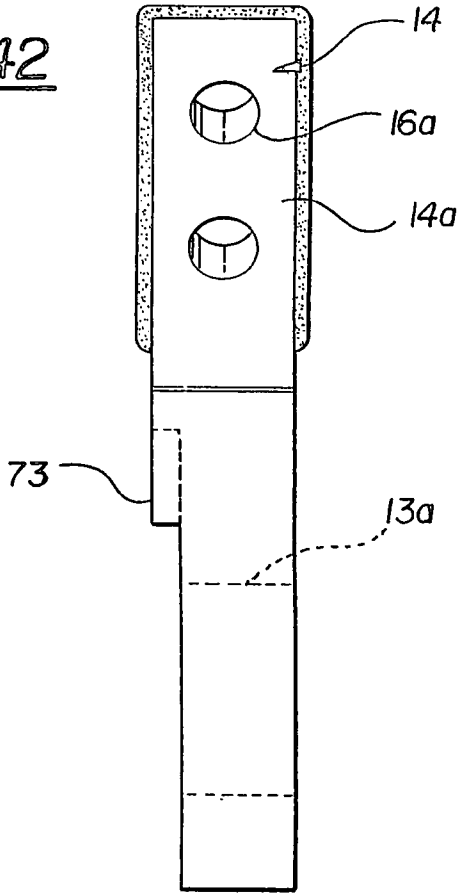
FIG. 42 is an end elevational view thereof.
Figure 46:
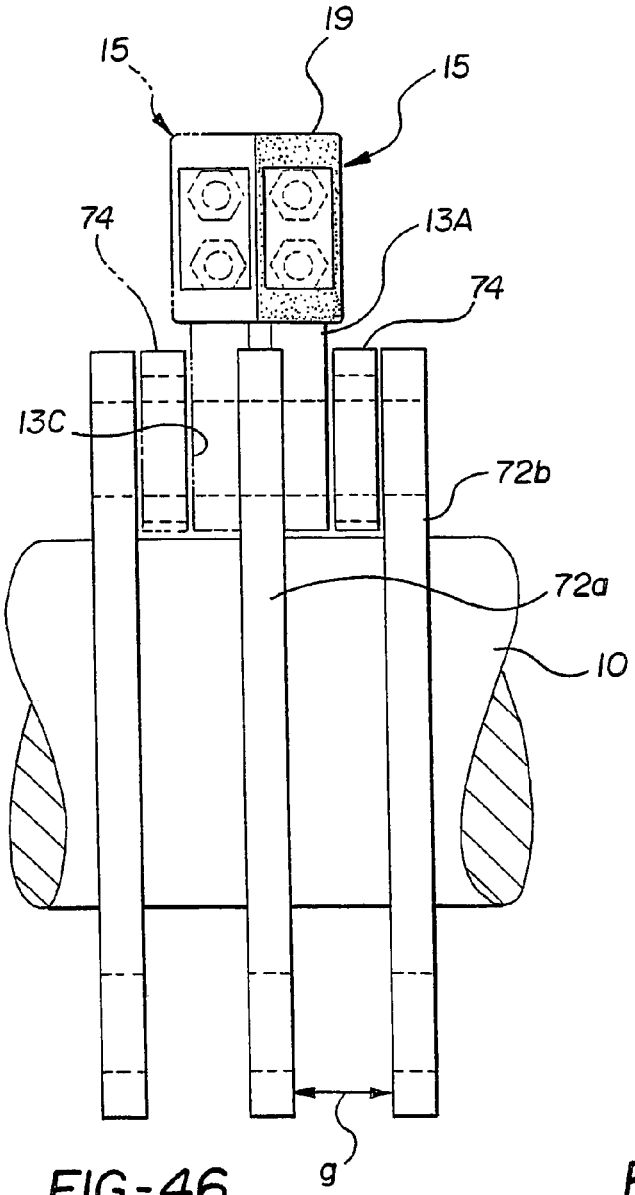
FIG. 46 is a schematic enlarged fragmentary plan view, showing an out of position hammer, which illustrates overlapping travel paths, in broken lines.
Figure 46A:
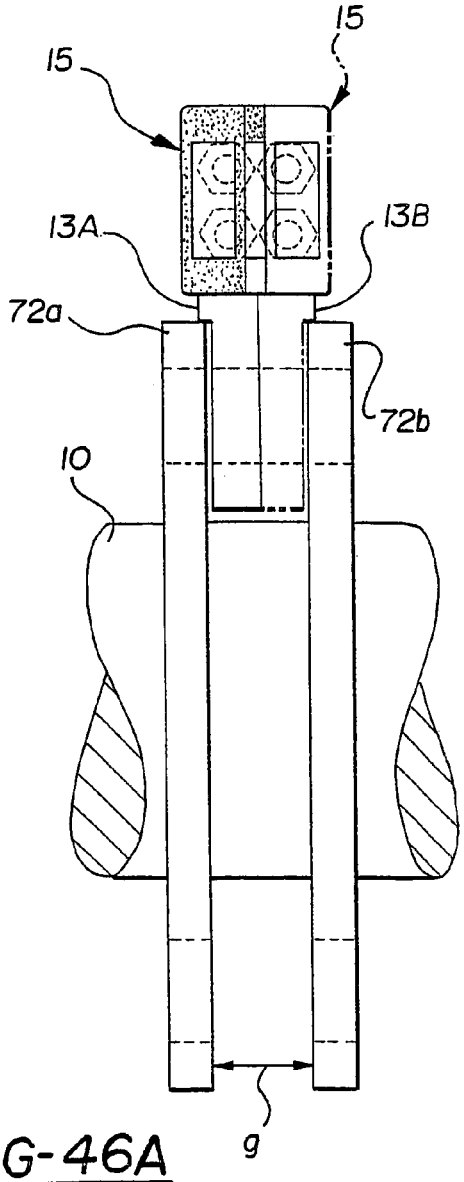
FIG. 46A is a similar view illustrating path overlap.

In FIGS. 39, 46, and 46A, the rotor members involved in these figures have been designated as 72*a* and 72*b*. The hammer supports involved have been designated as 13A, 13B, and 13C. It will be assumed that in FIG. 46A, only the hammer support 13A is shown in its true position. Hammer support 13B is shown in a broken line position and, of course, would truly be circumferentially displaced from hammer body 13A. However, by showing hammer body or support 13B in a rotated position, it is possible to show the three quarter inch axial path overlap which is achieved.

With particular attention now to FIG. 46 and with the hammer support 13A again being shown in its true position, it is possible to show that when hammer support 13A is in true position, and hammer support 13C is rotated out of true position to the broken line position in FIG. 46, an axial path overlap of a quarter of an inch is achieved. This means that the entire axial surface of the work is covered during rotation of the knives, which along the axis r of the rotor assembly have paths of rotation which are entirely axially overlapping, while being displaced circumferentially with respect to one another. The overlap is created by shouldering or insetting the hammer bodies at 73 an amount Q on one side of the hammer bodies to achieve the overlap desired.

Figure 47:
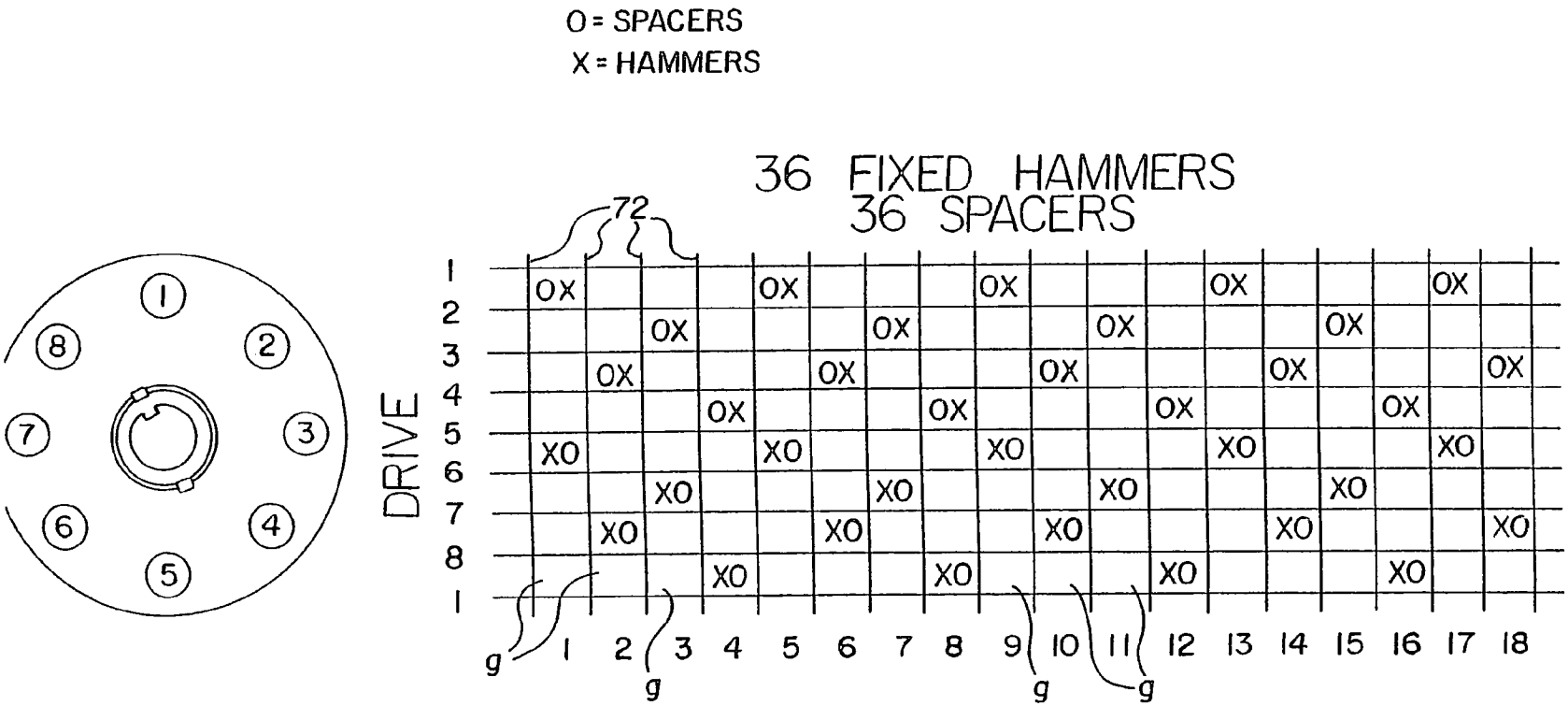
FIG. 47 is a schematic diagram illustrating hammer and spacer disposition along the axial length of the rotor assembly.

The diagram, FIG. 47, illustrating a further arrangement discloses the various rods or support members designated 1–8 at the left end and illustrates these positions in clockwisely arranged vertical position in the hammer-spacer designation part of the diagram. The hammers of FIGS. 46 and 46A are indicated by the letters X and the deflector members 74 termed spacers by the letters O in the diagram, and the disposition of the members 74 and hammers is well indicated in the spaces g between rotor members or the disc or plate representations 72. As will be seen, there is a deflector member spacer 74 indicated at O for each hammer X and they are arranged as indicated in the axial spaces g between the rotor discs or spacers 72 which are numbered 1–18. The disposition of the hammers and deflectors 74 circumferentially is portrayed in the diagram. In this embodiment the hammers are not in true radial alignment in the gaps or spaces g.

In operation, the offset tilted hammer heads 14 operate as previously but take a more aggressive bite and the cutting edges have an overlapping path of travel.

Figure 44:
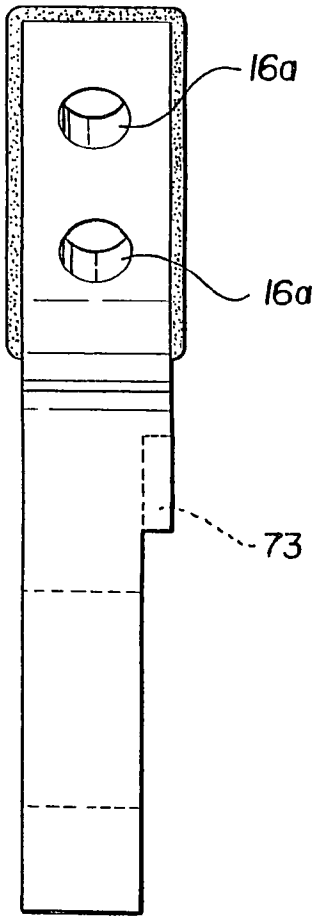
FIG. 44 is an end elevational view thereof.
Figure 51:
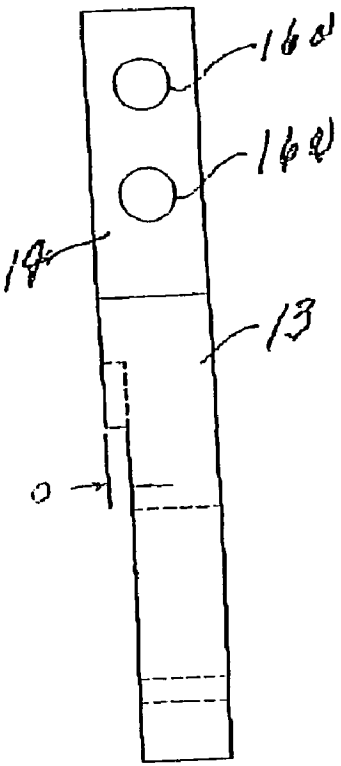
FIG. 51 is an end elevational view thereof.
Figure 50:
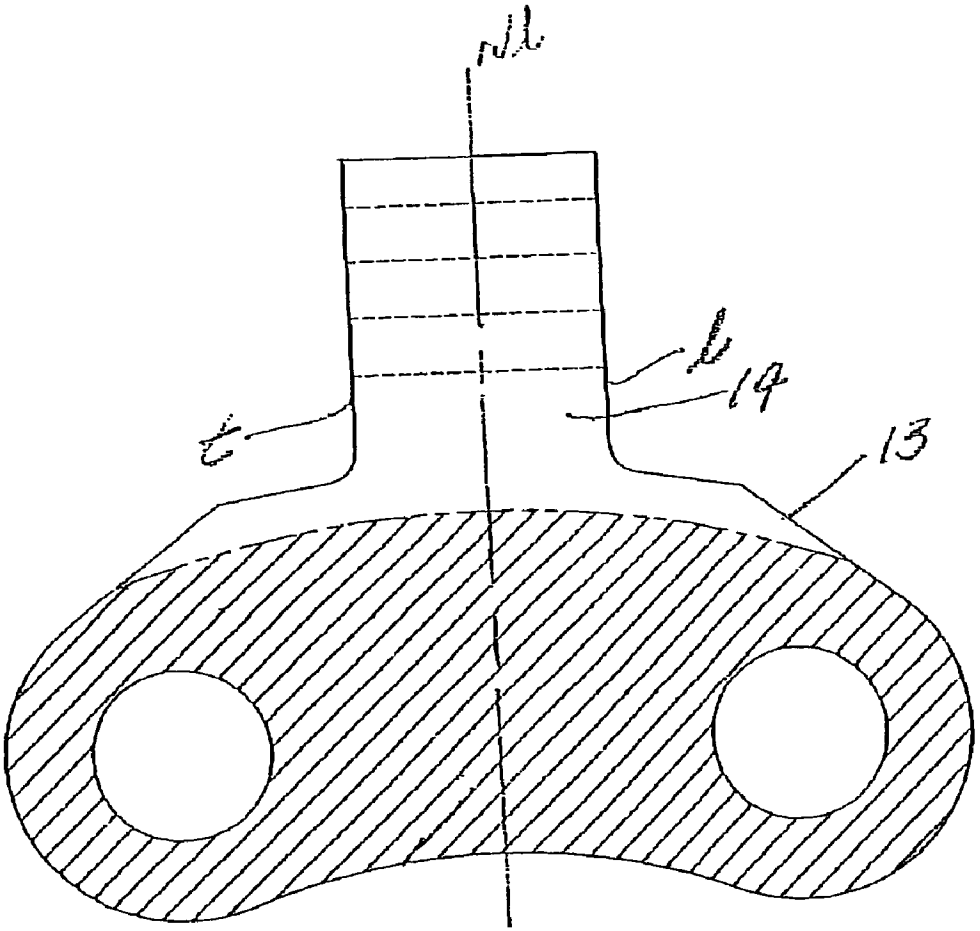
FIG. 50 is an enlarged side elevational view of a typical end reversible hammer head.

In FIGS. 50 and 51, a modified hammer support is disclosed which includes the same body portion as shown in FIGS. 43 and 44 with the inset or recessed shoulder portion 73. The present hammer support differs from the forwardly tilted hammer head 14 disclosed in FIGS. 43 and 44 in that it is symmetric on each side of its center line rl, which is a radial line substantially bisecting the axis of shaft 10. In this case, the same pair of rod openings 16*a* are provided in the hammer support head 14 and the leading and trailing faces l and t are parallel to one another, and parallel to line rl. With this configuration, the knife structure or hammer, generally designated previously as 15, may be mounted on either the face l or, if the hammer support is axially reversed, on the face t.

Figures 48, 49:
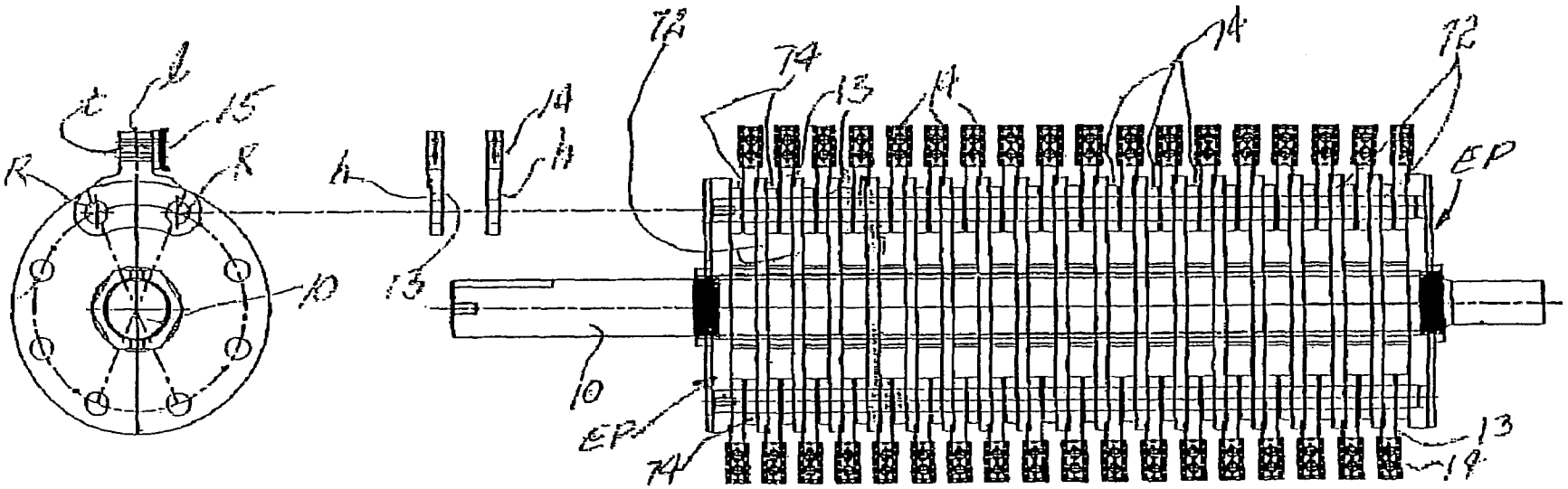
FIG. 48 is a fragmentary, schematic side view of a similar rotor assembly having hammers with heads which can mount knife structures on either of their front and rear faces so that when one face is worn, or there is reason to reverse a hammer head for position in a different array, it can be readily accomplished.
FIG. 49 is a schematic side elevational view of one of the hammer heads with a knife mounted in one cutting position.

In FIG. 48, each disc or rotor 72 is shown as carrying a pair of hammer supports including an upper hammer support 13 on one side of a disc 72 and a similarly disposed lower hammer support 13 on the opposite side of the disc 72, 180° apart. The deflector members or plates 74 are provided axially between each hammer support 13 and the adjacent disc or rotor 72 and function also to hold each hammer support away from the rotor disc 72 it is not to rest against. At the ends of the rotor assembly, it will be noticed that hammer supports 13 are provided which rest on each end plate assembly, generally designated EP, with the construction disclosed in FIGS. 48 and 49. The hammer supports 13 are 180° reversible on the rods R, and when their leading faces are worn or damaged, the hammer supports may be reversed in the sense that formerly trailing faces t are now the leading faces and the formerly leading faces l are now the trailing faces. On any one rotor disc, the disposition of the hammer supports is simply reversed with respect to the disc 72. For example, considering FIG. 48, the upper hammer supports would now be mounted on the rods R to abut the opposite sides of the disc 72 on which they are shown mounted in FIG. 48 and the lower hammer supports 44 simply reversed to mount on the opposite side of the discs 72 on which they are shown in FIG. 48. Also, the position of the reversible plates 74 may be changed to accommodate the new position of the hammer supports and hammers which are driven in rotation by rods R, end plates EP and shaft 10. In FIG. 48, the hammer supports are shown at h in reversed position. While in FIG. 48, only one pair of the hammer supports is shown in 180° spaced relationship, it is to be understood that they may be used in many other desired relationships. For example, in FIG. 49, the rods R are so disposed that two pairs of knives may be provided and the pairs may be disposed in an axially staggered or helical array, as disclosed in previous embodiments in a manner to preserve dynamic balance.

The disclosed embodiment is representative of a presently preferred form of the invention, but is intended to be illustrative rather than definitive thereof. The invention is defined in the claims.

I claim:

1. In a fragmenting rotor assembly for waste wood and other fragmentable material:

a. a drive shaft and mechanism for driving said shaft in a direction of rotation, said drive shaft incorporating axially spaced radially projecting rotors along its axis;

b. a series of radially projecting side for side reversible hammer mounting hammer supports selectively situated along the axis of said shaft on said rotors and powered by said shaft, the hammer supports having radially outward heads with a rotatively leading face portion and a parallel trailing face portion adapted to selectively mount said hammers radially outward of said rotors;

c. said hammers comprising fragmenting knives removably secured to the rotatively leading portions of said hammer supports;

d. said knives having axially extending reducing edges; and e. said hammer supports being mounted at the sides of said rotors to partly overlie said rotors axially to define axially abutting adequate radial support for paths of knife travel.

2. The assembly of claim 1 wherein pairs of said hammer supports at angular intervals are mounted on opposite sides of said rotors, the hammer supports being changeably mounted on the rotors so that the trailing face of said hammer head on one hammer support may become the leading face of a hammer head mounted on the opposite side of said rotor when its leading face is worn and the hammer support is turned over and mounted on the opposite side of a rotor.

3. The assembly of claim 1 wherein changeable deflector members are situated axially between said hammer heads and adjacent rotors, said deflector members being in radial alignment with said hammer heads on adjacent rotors.

4. The assembly of claim 1 wherein said hammer supports mount on rods extending axially parallel to said shaft through said rotors at equi-spaced circumferential intervals and said hammer supports on each rotor are oppositely disposed pairs provided at 180° intervals, said pairs of hammer supports on adjacent rotors being provided in axially staggered relation.

5. The assembly of claim 4 wherein said pairs of hammer supports are in 45° offset relation.

6. The assembly of claim 4 wherein each hammer support has a trailing portion extending radially alongside one side of a rotor which mounts on a pair of said rods, and an inset shouldered head portion with a radially inner curvilinear surface nesting on said rotor periphery and extending radially outwardly therefrom partly in radial alignment with said rotor.

7. The assembly of claim 6 wherein said deflectors are chain link configured and each has openings removably received on a pair of said rods.

8. The assembly of claim 3 wherein said deflectors comprise elongate members which include mid-portions with curvilinear exterior surfaces and radially inner conforming surfaces nesting with said shaft; said deflector mid-portion having end portions with radially outer deflector surfaces and having openings receiving said rods.

9. In a fragmenting rotor assembly operable with anvil surface for comminuting waste wood and other fragmentable material:

a. a drive shaft and mechanism for driving said shaft in a direction of rotation, said drive shaft incorporating axially spaced discs along its axis;

b. a series of side for side reversible radially projecting knife supports situated along the axis of said shaft on said discs and powered by said shaft, the knife supports having radially outward heads with a generally radial leading face portion and a substantially paralled trailing face portion;

c. fragmenting knives removably secured to said leading face portions of said knife supports;

d. said knives having axially extending reducing edges and said leading and trailing faces having fastening elements for mounting said knives selectively on said face portions; and e. said knife supports being mounted at the sides of each disc with the discs being so spaced that said knives on the confronting sides of adjacent discs have axially overlapping paths of travel.

10. The assembly of claim 9 wherein deflector members are provided in radial alignment with said knife supports circumferentially between them.

11. The assembly of claim 10 wherein a series of circumferentially spaced axially extending rods are provided to extend between said discs, and said knife supports and said deflector members are rigidly releasably mounted on said rods in radially alternating relation.

12. The rotor assembly of claim 11 wherein end plate assemblies are provided at each end of said rotor assembly and include end plates with cavities for receiving circumferentially adjustable locking plates, the end plates and locking plates both having rod receiving openings which can be aligned in a rod removing position and which receive said rods.

13. In a fragmenting rotor assembly operable with an anvil mechanism for fragmenting waste wood and other fragmentable material:

a. a drive shaft assembly including a mechanism for driving said shaft assembly in a direction of rotation about an axis of rotation, said drive shaft assembly incorporating axially spaced radially projecting rotors along its axis;

b. a series of side for side reversible radially projecting hammer supports powered by said shaft assembly situated along the axis of said shaft assembly and positioned to lie sidewisely contiguously to said rotors along said axis, the hammer supports extending radially outward of said rotors and having heads with a rotatively leading face portion and a trailing face portion;

c. hammers comprising fragmenting knives removably secured to said leading portions of said hammer supports;

d. said knives having axially extending reducing edges; and e. one of said contiguous hammer supports and rotors being sidewisely shouldered and providing shoulder receiving surface to be partly sidewisely received by shoulder received surface provided on the other.

14. The assembly of claim 13 wherein said sidewisely shouldered configuration and shoulder receiving surface are complementally curvilinear on generally a radius extending from said axis.

15. The assembly of claim 13 in which said hammer supports on opposite sides of said rotors are sidewisely shouldered to partly overlie said rotors from the opposite axial direction and thereby protect them.

16. The assembly of claim 13 in which said drive shaft assembly includes a plurality of circumferentially spaced rods extending axially parallely, and said hammer supports are non-rotatably received thereon, and deflector members circumferentially between said hammer supports and in substantial radial alignment with them mounted non-rotatably on said rods.

17. The rotor assembly of claim 13 wherein said knife edges have partly axially overlapping paths of travel and are axially helically positioned along said drive shaft assembly.

18. The rotor assembly of claim 13 wherein said rotors incorporate pairs of rotors and an axially contiguous pair of hammer supports with radially aligned axial deflectors and having side by side paths generally fill the space between said pairs of said rotors.

19. The rotor assembly of claim 13 in which said knife edges having partly overlapping paths of travel are sidewisely associated with opposite sides of the same rotor element.

20. In a fragmenting rotor assembly, operable with anvil surface for fragmenting waste wood and other fragmentable material:

a. a drive shaft and mechanism for driving said shaft in a direction of rotation about an axis, said drive shaft incorporating axially spaced radially projecting rotors along its axis;

b. a series of radially projecting side for side reversible hammer legs situated along the axis of said shaft on said rotors and powered by said shaft, the hammer legs having heads with a rotatively leading face portion and a generally parallel trailing face portion radially outward of said rotors and with knife securing elements on each face portion;

c. fragmenting knives having axially extending reducing edges removably secured to the leading portions of said hammer heads;

d. said hammer legs being mounted at the sides of said rotors to partly overlie said rotors axially and radially conformed to said rotors; and e. deflector members situated axially between said hammer legs and adjacent rotors, said deflector members being in substantial radial alignment with said hammer legs on adjacent rotors.

* * * * *